US007434373B2

(12) United States Patent
Pommier

(10) Patent No.: US 7,434,373 B2
(45) Date of Patent: Oct. 14, 2008

(54) METHOD FOR AUTOMATICALLY CUTTING AND REMOVING STACKS OF PIECES IN A WEB OF SHEET MATERIAL

(75) Inventor: François Pommier, Leognan (FR)

(73) Assignee: Lectra SA, Leognan (FR)

( * ) Notice: Subject to any disclaimer, the term of this patent is extended or adjusted under 35 U.S.C. 154(b) by 143 days.

(21) Appl. No.: 11/549,271

(22) Filed: Oct. 13, 2006

(65) Prior Publication Data

US 2007/0107572 A1 May 17, 2007

Related U.S. Application Data

(62) Division of application No. 09/763,445, filed as application No. PCT/FR00/01693 on Jun. 20, 2000, now abandoned.

(30) Foreign Application Priority Data

Jun. 21, 1999 (FR) ..... 99 07811

(51) Int. Cl.
*B65B 63/00* (2006.01)
*B26D 7/18* (2006.01)

(52) U.S. Cl. ..... 53/435; 53/443; 53/461; 53/520; 83/23; 83/27; 83/29; 83/90; 83/102; 83/940; 493/342; 493/373

(58) Field of Classification Search ..... 53/435, 53/520, 443, 447, 461; 83/23, 27, 29, 90, 83/91, 102, 940, 941; 493/342, 373
See application file for complete search history.

(56) References Cited

U.S. PATENT DOCUMENTS 3,495,492 A 2/1970 Gerber et al.
5,092,829 A 3/1992 Gerber
5,101,747 A 4/1992 Gerber
5,806,390 A * 9/1998 Pomerleau et al. ..... 83/29
5,825,652 A * 10/1998 LeBlond et al. ..... 700/132
6,308,602 B1 10/2001 Gerber
6,370,843 B1 * 4/2002 Bercaits et al. ..... 53/436

FOREIGN PATENT DOCUMENTS

DE 75 05 601 6/1975
DE 270 235 A1 7/1989

(Continued)

*Primary Examiner*—Stephen F Gerrity
(74) *Attorney, Agent, or Firm*—Smith, Gambrell & Russell

(57) ABSTRACT

Stacks of pieces (24) are cut out from the lay-up (20) on a cutting table, on the basis of recorded information relating to the locations of the pieces on the surface of the lay-up, and the skeleton (26) of the lay-up is split up (lines 28) into a plurality of portions while the stacks of pieces are being cut out. Then the lay-up is brought onto an unloading table (60) for successively unloading the stacks of cut-out pieces by causing an unloading tool (80) to move so as to bring it into contact with the stacks that have arrived on the unloading table, by using information relating to the locations of the pieces, and so as to take off each stack from the remainder of the lay-up merely by moving it substantially parallel to the plane of the lay-up, without interfering with the stacks of pieces that have not yet been unloaded.

22 Claims, 18 Drawing Sheets

FOREIGN PATENT DOCUMENTS

| | | | | |
|---|---|---|---|---|
| DE | 42 04 756 | A1 | | 5/1993 |
| EP | 453711 | A1 | * | 10/1991 |
| EP | 0 640 448 | A1 | | 3/1995 |
| EP | 0 841 130 | A1 | | 5/1998 |
| FR | 2661342 | A1 | * | 10/1991 |
| WO | WO 88/10228 | | | 12/1988 |

* cited by examiner

FIG.2
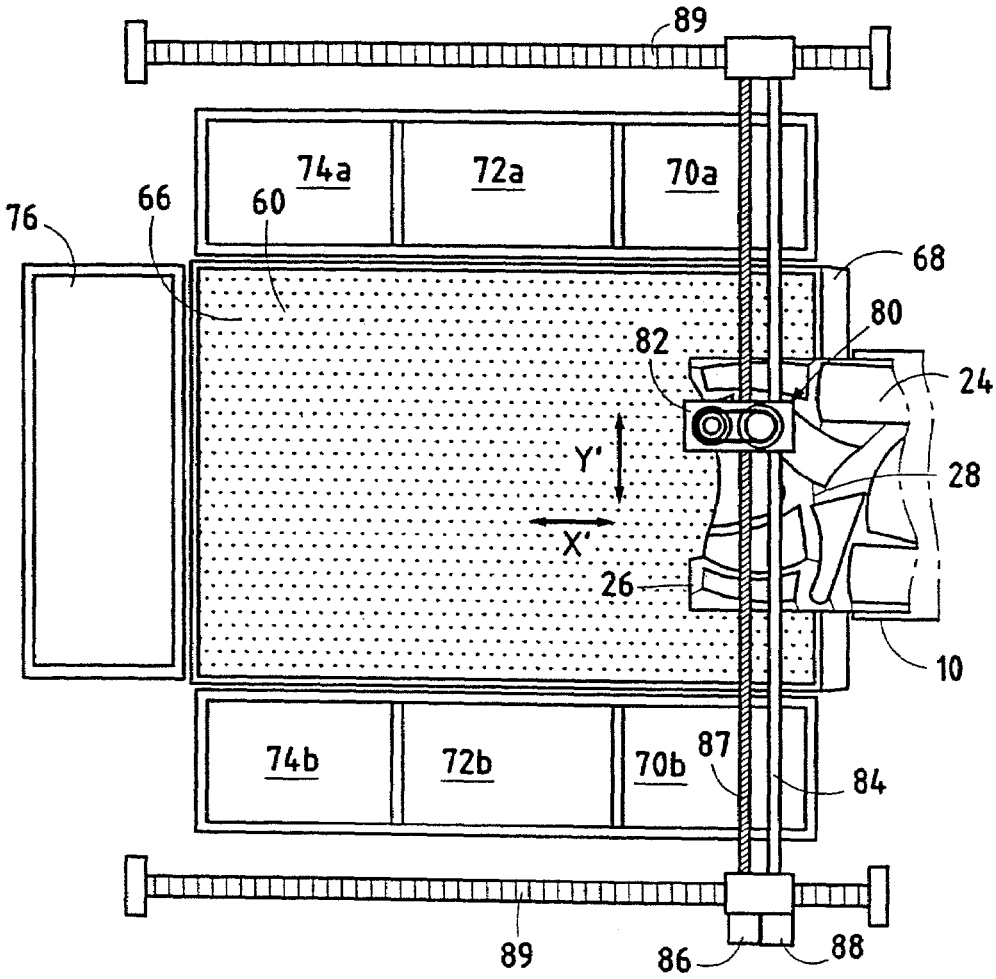
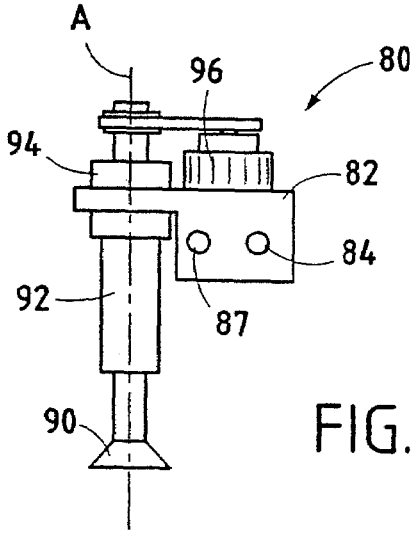
FIG.3

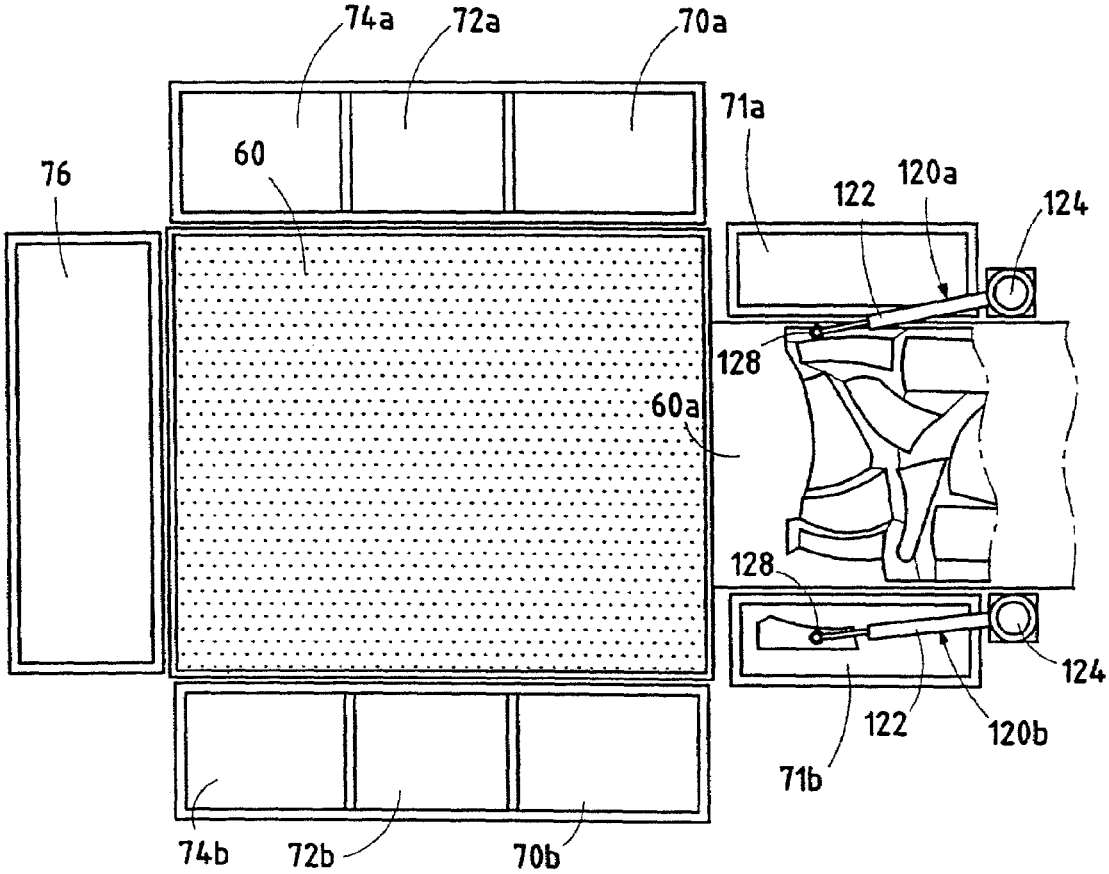
FIG.15
FIG.16
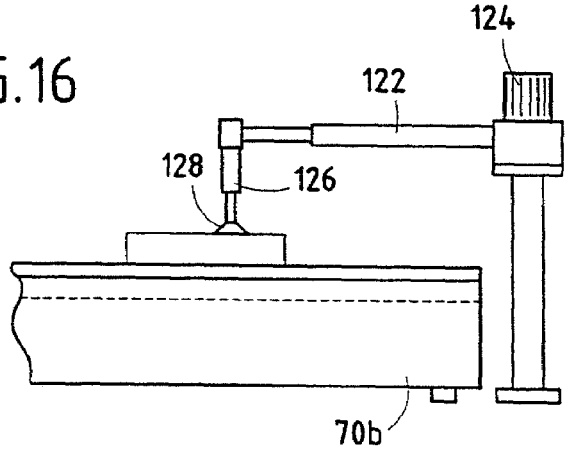

METHOD FOR AUTOMATICALLY CUTTING AND REMOVING STACKS OF PIECES IN A WEB OF SHEET MATERIAL

REFERENCE TO RELATED APPLICATION

This application is a division of U.S. patent application Ser. No. 09/763,445 filed Feb. 22, 2001 now abandoned, which claims the benefit of priority of PCT/FR00/01693 filed Jun. 20, 2000 and French Patent Application No. FR99/07811 filed Jun. 21, 1999, all of which disclosures are incorporated herein by reference.

FIELD OF THE INVENTION

The invention relates to automatically cutting out stacks of pieces from a "lay-up" of sheets of a sheet material, e.g. to cutting up woven fabrics in the clothing, furniture, or automobile upholstery industries, or to cutting up technical textiles or non-textile sheet materials in other sectors of industry.

More particularly, the invention relates to separating and unloading the stacks of pieces after they have been cut out from the lay-up.

BACKGROUND OF THE INVENTION

Taking the example of the clothing industry, garment production is usually organized around a cutting workshop equipped with at least one cutting machine operating on a lay-up in compliance with a predetermined layout, and a manufacturing or assembly workshop in which the cut-out pieces are assembled together and stitched together, and the resulting garments are finished.

The products resulting from cutting up the lay-up must be processed to enable them to be used by the manufacturing workshop.

In particular, it is necessary to separate the stacks of cut-out pieces from the offcuts. The offcuts constitute the stencil-like remaining "skeleton" of the lay-up, i.e. the portion of the lay-up that is complementary to the stacks of cut-out pieces. It can also be necessary to sort, to identify and/or to wrap the stacks of cut-out pieces so as to constitute coherent batches before they are conveyed to the manufacturing workshop.

It is common for the operations of separating the stacks of cut-out pieces from the skeleton of the lay-up, and of sorting the cut-out pieces to be performed manually by an operator. To help the operator to distinguish between the stacks of cut-out pieces and the portions of the skeleton, it is often necessary for each stack to be marked in order to be identified easily.

Procedures have been considered for enabling the stacks of cut-out pieces to be separated from the skeleton of the lay-up automatically.

Thus, U.S. Pat. No. 5,101,747 proposes an installation in which the skeleton of the lay-up is taken away at the outlet of the cutting station by being pulled upwards out of the horizontal path of the lay-up, while a roller presses the lay-up to help the stacks of cut-out pieces to separate from the lay-up and to fall under gravity into a collector bin. Unfortunately, it is necessary to stitch the pieces of each stack together to prevent the stacks from falling apart. It is also necessary to sort the collected stacks of pieces, and that can require marking the stacks in order to assist an inexperienced operator or when the pieces are similar in shape. It is also necessary for the lay-out of the pieces to be cut out to be such that it leaves the skeleton of the lay-up in one piece, which requires the pieces to be spaced apart sufficiently from one another and from the edges of the lay-up, and therefore prevents the material from being used optimally.

U.S. Pat. No. 5,092,829 proposes inserting link members into the stacks of cut-out pieces and picking up the stacks of pieces by means of a robot arm suitable for grasping the link members as engaged through the pieces. The movements of the robot arm are controlled by a control unit as a function of stored information relating to the locations of the stacks of pieces in the lay-up. Unfortunately, that system suffers from the major drawback of requiring a link member, e.g. a serrated rod to be inserted into the stacks of pieces. In many cases, this results in the material being damaged unacceptably.

OBJECT AND SUMMARY OF THE INVENTION

An object of the invention is to provide a method of automatically unloading stacks of pieces cut out from a lay-up, which method does not require the pieces in each stack to be linked together in order to make the stack coherent, and does not require link and pick-up members to be inserted through the stacks.

Another object of the invention is to provide an automatic unloading method that does not put any significant constraint on how the pieces are laid out, and that therefore enables the material to be used optimally.

Yet another object of the invention is to provide a method of automatically unloading stacks of pieces, which method does not require prior labelling of the stacks.

The invention provides a method of the type comprising: cutting out stacks of pieces from the lay-up on a cutting table, on the basis of recorded information relating to the locations of the pieces on the surface of the lay-up; and unloading the stacks of pieces by means of at least one unloading tool that is controlled automatically; the method further comprising the steps consisting in:

splitting up the skeleton of the lay-up into a plurality of portions while the stacks of pieces are being cut out on the cutting table;

progressively bringing the lay-up onto an unloading table with the lay-up comprising the stacks of cut-out pieces and the skeleton of the lay-up as not separated from one another; and successively unloading the stacks of cut-out pieces by causing the unloading tool to be moved so as to bring it into contact with the stacks that have arrived on the unloading table, by using the information relating to the locations of the pieces, on the surface of the lay-up, and so as to take off each stack from the remainder of the lay-up merely by moving it substantially parallel to the plane of the lay-up, without interfering with the stacks of pieces that have not yet been unloaded, the stacks of cut-out pieces and the portions of the skeleton of the lay-up being unloaded in a manner such as to clear the way on the unloading table for the stacks of pieces that have not yet been unloaded.

The invention is remarkable by the fact that, by splitting up the skeleton of the lay-up, the stacks of cut-out pieces can be taken off form the lay-up one after another merely by causing them to slide parallel to the unloading table. The absence of interference with the stacks of pieces remaining in the lay-up makes it possible to retain the position references of them so that they can be reached subsequently by the unloading tool.

Advantageously, the splitting up of the lay-up is performed in a manner such as to determine a take-off corridor for each stack of pieces, which corridor is defined by a preferred slide direction and by a width. The preferred slide direction may include non-rectilinear portions, a stack of pieces being moved in translation and/or in rotation over the unloading table. The width of the take-off corridor is not less than the maximum dimension of the stack of pieces as measured perpendicular to the slide direction. Take-off corridors may be defined in the same way for at least some of the portions of skeleton of the lay-up.

The stacks of pieces may be moved over the unloading table by supporting them on a cushion of air, or on rolling means. Each stack of pieces may be driven over the unloading table merely by the unloading tool bearing against the surface of the stack.

Each stack of pieces may be accompanied by the unloading tool to a collector device or propelled to a collector device under movement imparted by the unloading tool.

The unloaded stacks of pieces may be directed to at least one collector device to constitute predetermined sets, e.g. coherent batches to be sent to the assembly workshop, or to form therein at least one queue ordered in predetermined manner, e.g. a queue of pieces disposed on a conveyor in a predetermined order so as to be conveyed to the assembly workshop.

Provision may be made to unload as a single stack each set of a plurality of adjacent stacks in the lay-up whose pieces have shapes such that they are mutually interlocking, and such that it is impossible to separate them merely by moving them parallel to the plane of the lay-up. Interlocking smocks can be separated manually at a subsequent stage.

Provision may also be made, more particularly for stacks of pieces of small or very small size, to leave the stacks included in non-fragmented portions of the lay-up. Each of such stacks of pieces is then unloaded together with the portion of the lay-up that surrounds it, which, by offering a larger area, facilitates handling by the unloading tool. The stack of pieces and the portion of lay-up in which it is included can be separated manually at a subsequent stage, it being possible for said portion of lay-up to be a portion of skeleton or another stack of pieces.

Advantageously, not only are the stacks of pieces unloaded automatically, but also at least some of the portions of the skeleton of the lay-up are removed automatically by means of the unloading tool.

In a feature of the method, portions of the skeleton of the lay-up, in particular those portions which are situated along the longitudinal edges of the lay-up, may be removed from the unloading table by automatic removal means that are distinct from the unloading tool.

In another feature of the method, portions of the skeleton of the lay-up, in particular offcuts of small size, may be swept off by means of the unloading tool travelling over the unloading table, the unloading tool then preferably being provided with sweeping means for this purpose.

When the lay-up is covered with a plastics film prior to cutting out the stacks of pieces, the portion of plastics film cut out with each stack of pieces and situated on each stack may be taken off automatically before the stack of pieces is removed from the unloading table. Each portion of plastics film is advantageously taken off by means of the unloading tool, e.g. by suction.

In yet another feature of the method, the unloaded stacks of pieces may be wrapped individually. The unloaded stacks of pieces may be marked, e.g. by print means or labeling means carried by the unloading tool, or after the stacks of pieces have been wrapped.

The invention also provides an installation making it possible to implement the automatic cutting-out and unloading method described above.

In the invention, such an installation comprises: a cutting table; first movement-imparting means for moving a lay-up over the cutting table; a cutting tool; second movement-imparting means for moving the cutting tool above the cutting table; a control unit connected to the first and second movement-imparting means so as to cause the cutting tool and a lay-up carried by the cutting table to be moved relative to each other in order to cut out stacks of pieces from the lay-up as a function of stored lay-out information relating to the locations of the pieces to be cut out on the surface of the lay-up; at least one unloading tool for automatically unloading stacks of cut-out pieces; and third movement-imparting means for moving the unloading tool and connected to the control unit so as, in particular, to bring the unloading tool up to the stacks of cut-out pieces to be unloaded;

an unloading table above which the unloading tool may be moved, and in that the control unit is organized (or programmed) for:

controlling the relative movements between the cutting tool and a lay-up carried by the cutting table in order to cut up the skeleton of the lay-up into a plurality of portions; and controlling the movements of the unloading tool so as to bring it into contact with the stacks of cut-out pieces that arrive with a lay-up on a surface of the unloading table situated downstream from the cutting table, and so as to take off the stacks of cut-out pieces successively from the remainder of the lay-up by moving them over the unloading table merely by moving them substantially parallel to the surface of the unloading table.

Advantageously, the surface of the unloading table has a plurality of orifices and the unloading table is connected to blower means so that it can support the stacks of cut-out pieces via a cushion of air.

In a variant, the surface of the unloading table is provided with rolling means.

The unloading tool, e.g. provided with a finger or with plurality of fingers between which the spacing is variable, is advantageously mounted to move between a raised position and a lowered position so that it comes to bear against the top surface of a stack of cut-out pieces by being moved from its raised position to its lowered position.

In addition, the unloading tool may be mounted to rotate about an axis perpendicular to the unloading table relative to a tool support mounted to move parallel to the unloading table, so as to enable stacks of pieces to be taken off by turning them about their own axes when necessary.

BRIEF DESCRIPTION OF THE DRAWINGS

Other features and advantages of the method and of the installation of the invention appear from reading the following description given by way of non-limiting example and with reference to the accompanying drawings, in which:

FIG. 2 is a very diagrammatic plan view of the unloading station of the installation shown in FIG. 1;

FIG. 3 is detail view in elevation of the unloading tool of the installation of FIG. 1;

FIG. 15 is a very diagrammatic plan view showing another embodiment of an unloading station of an installation of the invention, with removal means distinct from the unloading tool being provided for removing fragments of lay-up skeleton;

FIG. 16 is a diagrammatic elevation view of the removal means shown in FIG. 15;

Detailed description of preferred implementations and embodiments

Figure 1:
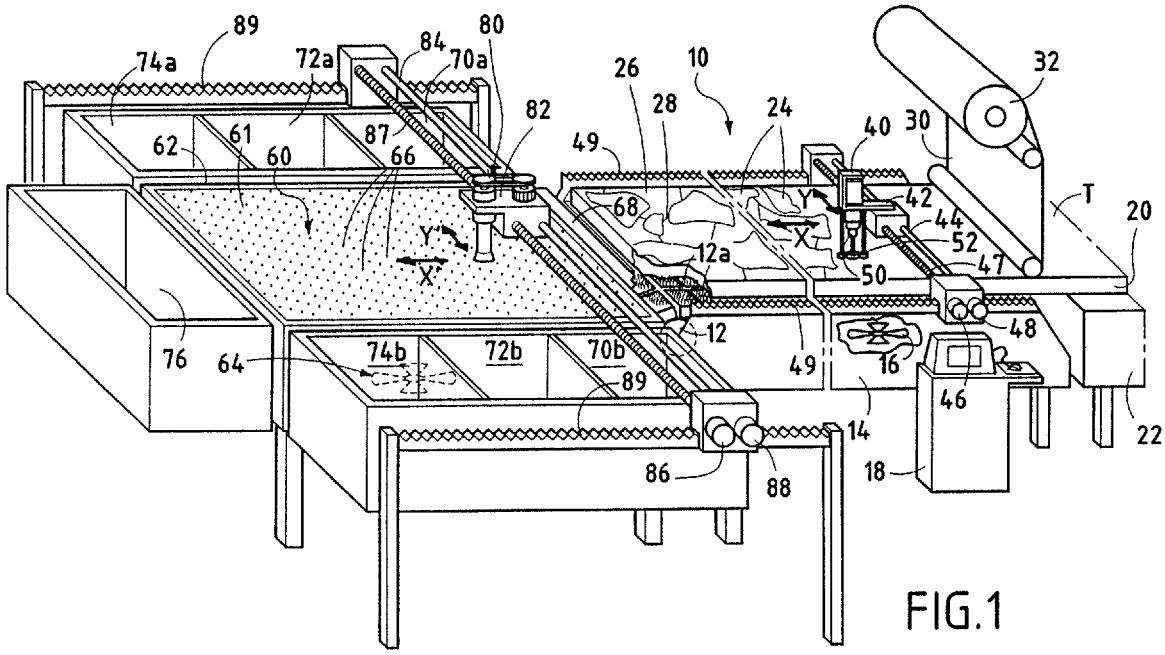
FIG. 1 is a very diagrammatic overall perspective view of an embodiment of an installation making it possible to implement the invention.

General Description of an Embodiment of the Installation and of how it Operates An embodiment of an automatic cutting and unloading installation making it possible to implement a method of the invention is shown very diagrammatically in FIG. 1.

Cutting is performed on a cutting table 10 constituted by the horizontal top run of an endless conveyor 12. Except for its horizontal top surface defining the table 10, the conveyor is housed inside a case 14. Suction means such as one or more extractor fans 16 are disposed inside the case so as to establish suction therein.

The conveyor 12 is made up of support blocks 12*a* provided with passageways or forming passageways between them, which passageways cause the inside of the case to communicate with the surface of the table 10. Each of the blocks 12*a*, which are, for example, made of a plastics material, includes a base from which a plurality of filamentary elements project. In this way, a blade, can penetrate into the surface of the table 10 and move horizontally in all directions without being damaged by and without damaging the support blocks 12*a*.

A flexible sheet material e.g. a woven fabric T, to be cut up is brought onto the table 10 in superposed layers forming a lay-up 20. The lay-up is formed on a laying-up table 22, upstream from the cutting table. The lay-up 20 is advanced on the cutting table along the X axis by actuating a drive motor (not shown) of the conveyor 12.

A transparent film 30 of airtight plastics material, e.g. a film of polyethylene paid out from a roller 32, is deposited on the lay-up 20 in order to cover it completely.

The lay-up 20 carried by the table 10 and covered with the film 30 is cut up by means of a cutting head 40. The cutting head may be brought into any position above the cutting table 10 by causing it to move horizontally parallel to the longitudinal axis X of the conveyor 12 and parallel to the transverse axis Y perpendicular to X.

The cutting head 40 is mounted on a carriage 42 which is mounted to move along the Y axis along a cross-beam 44 under drive from a motor 46. The cross-beam 44 is guided at its ends along the longitudinal edges of the conveyor 12, and it is driven along the X axis under drive from a motor 48. The carriage 42 may be driven conventionally by means of cables, or, as shown, by means of a worm screw 47. The cross-beam 44 may also be driven by means of cables or of a worm screw, or, as shown, by pinions and racks 49, the racks being fixed to the top longitudinal margins of the case 14.

The cutting head 40 carries a cutting blade 50 suspended vertically and passing through a presser foot 52. The blade 50 and the presser foot 52 are mounted to move between a raised (rest) position and a lowered position in which the presser foot is in contact with the lay-up 20. The lay-up is cut up by driving the blade 50 in a reciprocating vertical motion and by moving the cutting head 40. The blade 50 and the presser foot 52 are further steerable about a vertical axis so as to follow the outlines of the pieces to be cut out from the lay-up.

Via links and drive members (not shown), a control unit or computer 18 controls the movements of the cutting head 40 along the X and Y axes, the raising and the lowering of cutting blade 50 and of the presser foot 52, the vertical reciprocating motion of the blade 50, and the angular positioning of the cutting blade 50 and of the presser foot 52. The computer 18 also controls the advancing of the conveyor 12 and the establishment of suction in the case 14 so that the lay-up 20 as covered by the airtight film 30 is firmly held against the cutting table 10.

An installation such as the installation described above is well known to the person skilled in the art. For example, reference may be made to Patent Document U.S. Pat. No. 3,848,490.

The cutting head is moved along the X and Y axes in a manner such as to cut out the pieces from the lay-up in compliance with a predetermined layout by forming stacks of pieces 24. During cutting out, the cutting blade 50 is angularly positioned such that it remains tangential or substantially tangential to the outline of the cut-out piece. Once a segment of lay-up 20 present on the cutting table 10 has been cut up, with the airtight film 30, the conveyor 12 is caused to advance so as to advance a new segment of lay-up or a new lay-up onto the cutting table. It is also possible to cause the lay-up to be advanced without interrupting the cutting-out, successive lengths of lay-up being brought into the working zone of the cutting table 10 as the cutting-out operation progresses. A method of advancing the lay-up during cutting-out so that no time is lost merely advancing the lay-up is described in Document WO-A-95/02489.

The laying-out operation, performed prior to cutting-out, consists in determining the locations of the pieces to be cut out. Laying-out is performed such as to minimize wastage of material, while complying with certain constraints (complying with the grain, maintaining at least minimum spacing between the pieces to be cut out . . . ). Prior to cutting-out, and as described below in detail, the locations of cutting-up lines 28 along which the skeleton of the lay-up is to be cut up are defined on the surface of the lay-up. These locations are chosen so that, during the cutting-out operation, the skeleton is split up such that the stacks of pieces can be subsequently and successively separated from the portions of skeleton merely by moving them parallel to the surface of the lay-up.

The lay-out information relating to the locations of the pieces at the surface of the lay-up and the skeleton fragmentation information relating to the locations, on the surface of the lay-up, of the cutting-up lines along which the skeleton is to be cut up is recorded in a memory of the computer 18.

Downstream from the cutting table 10, the lay-up arrives at an unloading station comprising an unloading table 60 situated in alignment with and substantially on the same level as the cutting table.

The unloading table 60 (FIGS. 1 and 2) is formed by the top wall of a case 62. Blower means 64 are connected to the case 62 in order to raise the pressure inside said case. The surface 61 of the table 60 is provided with a multitude of orifices 66 communicating with the inside of the case 62 so as to generate a cushion of air at the surface of the table 60. It should be noted that the blower means may be constituted (at least in part) by the suction means 16, the air sucked in by said suction means being injected into the case 62. The table 60 has a lip 68 at its upstream edge, which lip connects to the cutting table 10.

Under the effect of the advance produced by the conveyor 12, the lay-up 20 comprising the stacks of cut-out pieces 24 and the complementary portion or "skeleton" 26, is brought progressively onto the horizontal surface 61 of the unloading table 60, without modifying the relative positions of the stacks of pieces 24 and of the 25 skeleton 26. Each stack of pieces 24 underlies a corresponding cut-out portion of the film 30. In addition, the skeleton 26 is fragmented by cutting-up 28 performed while the pieces are being cut out, and at predetermined locations.

One or (as in the example shown) more collector bins are disposed along one or more of the longitudinal and downstream edges of the unloading table 60. For example, it is possible to provide bins 70*a* and 70*b* situated along the longitudinal edges of the table 60 for the purpose of removing the skeleton 26 in fragments, and bins 72*a*, 74*a*, 72*b*, 74*b*, and 76 . . . situated along the longitudinal edges and along the downstream edge of the table 60 for the purpose of receiving stacks 24 of cut-out pieces.

The stacks 24 of pieces and the fragments of the skeleton 26 are unloaded by means of an unloading tool 80 which can be brought into any position above the unloading table and above the collector bins by being caused to move horizontally parallel to the longitudinal axis X' of the table 60 and to the transverse axis Y' perpendicular to X'.

The unloading tool 80 (FIGS. 1, 2, and 3) is mounted on a tool support 82 which is mounted to move along the axis Y along a cross-beam 84 under drive from a motor 86. The support 82 may be driven via cables or, as in the example shown, via a worm screw 87. The cross-beam 84 is guided at its ends along longitudinal guides and it is driven along the X' axis under drive from a motor 88. The cross-beam 84 may be driven via cables or via a worm screw, or else, as shown, via pinions and racks 89, the racks being mounted on the longitudinal guides.

The unloading tool 80 (FIG. 3) has an end 90 in the form of a finger or of a cup, e.g. made of rubber, fixed to the end of a telescopic rod 92 constituted, for example, by an actuator. The rod 92 is mounted to rotate freely in a bearing 94 secured to the tool support. A motor 96 is connected to the rod 92 for the purpose of rotating it about its own axis A perpendicular to the unloading table 60.

Via links and drive members (not shown), the computer 18 controls the movements of the unloading tool 80 along the X' and Y' axes, the raising and the lowering of the end of the tool by means of the rod 92, and the rotation of the tool about its axis A. The computer 18 also causes the pressure inside the case 62 to rise for the purpose of generating a cushion of air at the surface of the unloading table.

The stacks 24 of cut-out pieces are unloaded successively by means of the unloading tool 80, once they have reached the table 60 and can be taken off from the lay-up without interfering with the remaining other stacks of pieces, either directly or via fragments of skeleton 26 of the lay-up. To this end, the unloading tool is brought vertically above each new stack of pieces to be unloaded, by using the information relating to the layout of the pieces in the lay-up, as stored in the memory of the computer 18. The position of each stack of cut-out pieces is known on the basis of the layout information that determines the co-ordinates of the pieces relative to an origin on the lay-up, and on the basis of the advance achieved by moving the conveyor 12. The same applies for each portion of the skeleton of the lay-up. The movements of the unloading tool for the purposes of taking off each stack of pieces without interfering with the remaining stacks in the lay-up, and of unloading it into the corresponding collector bin are controlled on the basis of predetermined take-off and removal information stored in the memory of the computer 18 together with the piece lay-out information and the skeleton fragmentation information. A process of determining take-off information is described below in detail. The same may apply for at least certain portions of the skeleton.

It should be noted that the dimensions of the unloading table 60 are chosen to enable the stacks of pieces or portions of skeleton separated from the lay-up to be moved without interfering with the lay-up. Thus, the table 60 preferably has a width that is significantly larger than the width of the cutting table 10. In the example shown, the width of the table 60 is twice the width of the table 10, both tables having the same longitudinal midplane. In addition, the length of the table 60 is chosen so that it is no shorter than the longest possible dimension of pieces to be unloaded as measured along the X axis.

Furthermore, the stacks of pieces to be grouped together after being unloaded can be distributed in two bins situated on either side of the table 60, e.g. bins 72*a* & 72*b* or bins 74*a* & 74*b*. This makes it possible to direct a stack of pieces situated close to a longitudinal edge of the lay-up to the nearest bin without having to go around the portion of the lay-up that remains on the table 60.

Figure 4:
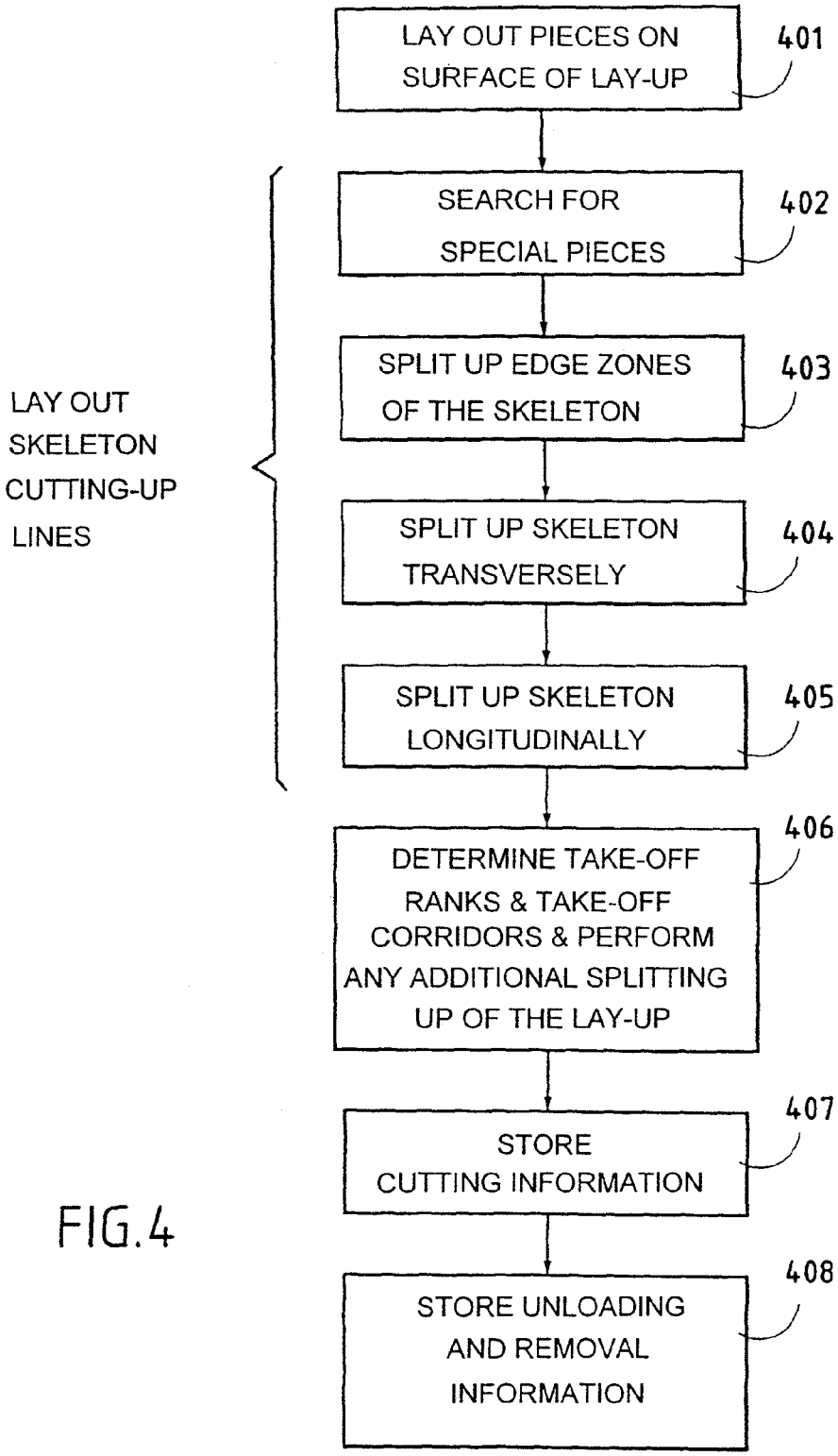
FIG. 4 is a flow chart of an automatic process for laying out stacks of pieces and lines along which the skeleton of the lay-up is to be cut up, and for determining take-off ranks and take-off corridors for implementing a method of the invention.

Predetermining the Fragmentation of the Skeleton of the Lay-up and the Take-off Ranks and Take-off Corridors The flow-chart in FIG. 4 shows, in general manner, the various steps making it possible to define a lay-out at the surface of a lay-up for pieces and for cutting-up lines along which the skeleton is to be cut up, to determine the order in which the stacks of pieces and portions of skeleton are to be taken off from the lay-up and unloaded after cutting-out and cutting-up, and to define the take-off corridors that must be followed during unloading.

Figure 5A:
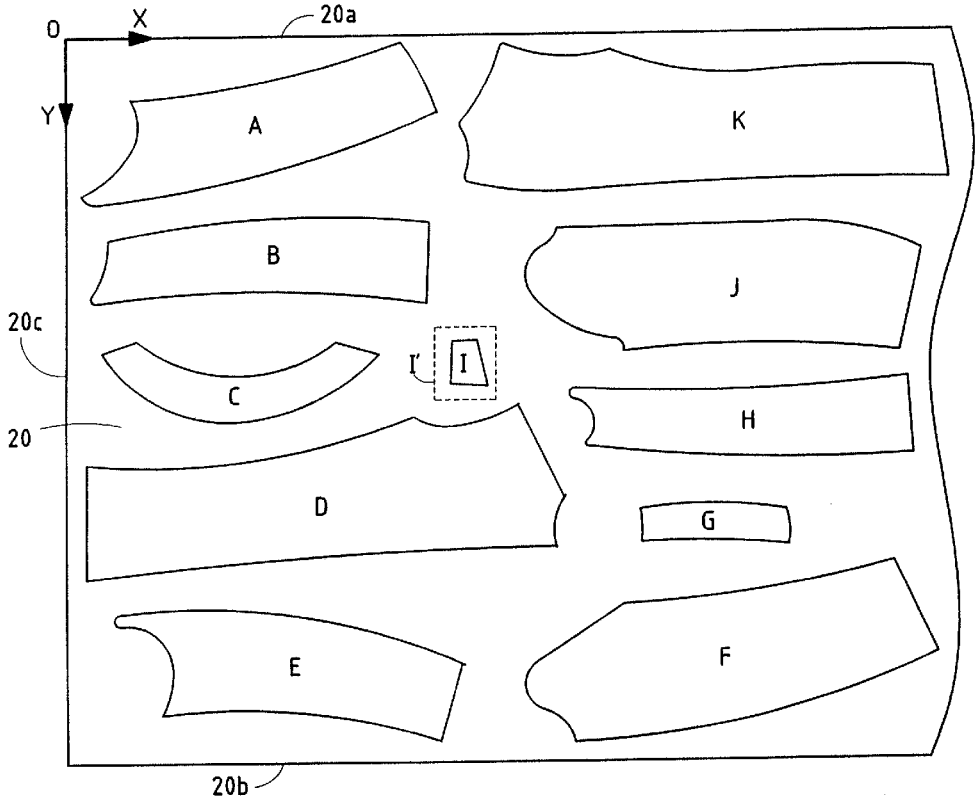
FIGS. 5A to 5F show how laying out is performed with a view to cutting out pieces, to fragmenting a skeleton, and to performing automated unloading, in an implementation of the method of the invention.

A preliminary step 401 consists in establishing a lay-out on the surface of the lay-up 20 for the pieces to be cut out. FIG. 5A shows an example of a lay-out on the front (or downstream) portion of the lay-up, with only pieces A to K being shown. An origin for the X and Y co-ordinates is set arbitrarily on the lay-up at a point 0, at the vertex of the angle formed by the front edge 20*c* and by a longitudinal edge 20*a* of the lay-up.

Automatic laying-out methods are well known. They aim to use the available material as well as possible while also satisfying certain constraints, e.g. complying with the grain of a woven fabric or maintaining sufficient spacing between outlines of adjacent pieces (so as to prevent the cutting blade from jumping into a path that it has already travelled and that is too close). In the example shown, the lay-out is clearly not optimized, the spaces between pieces being exaggerated to make the drawings clearer.

The cutting-up lines along which the skeleton of the lay-up is to be cut up are predetermined so that the skeleton is fragmented in a manner such that, at the unloading stage, the stacks of cut-out pieces and cut-out portions of skeleton can be taken off successively by being moved parallel to the surface of the lay-up without interfering with the remainder of the lay-up.

A first step 402 of the process consists in looking for special pieces in the lay-out.

A first category of special pieces comprises isolated pieces having areas or even widths that are too small for them to be handled correctly by the unloading tool, i.e. pieces of small size. A search is thus made for pieces of area or of maximum width smaller than predetermined threshold values, such as the piece I in FIG. 5A. In order to facilitate subsequent handling of them, these pieces are left included in non-fragmented portions of the skeleton of the lay-up that surround them, each of these pieces being separated from the portion of skeleton containing it after unloading, and, for example, manually. For each special piece of small size, a zone is defined around the piece. This zone is not to be crossed by skeleton cutting-up lines, and it has at least the minimum required area and width. For the piece I in FIG. 5A, this zone I' is shown in dashed lines.

A second category of special pieces comprises pieces interlocking with at least one other piece and/or with at least one portion of skeleton, with their shapes interlocking so that it is impossible for them to be separated by being moved in translation parallel to the surface of the lay-up. Such pieces can be detected by searching for those for which the outline defines an analytic function having a derivative with sign inversion, regardless of the axis taken as the axis of co-ordinates.

Figure 6:
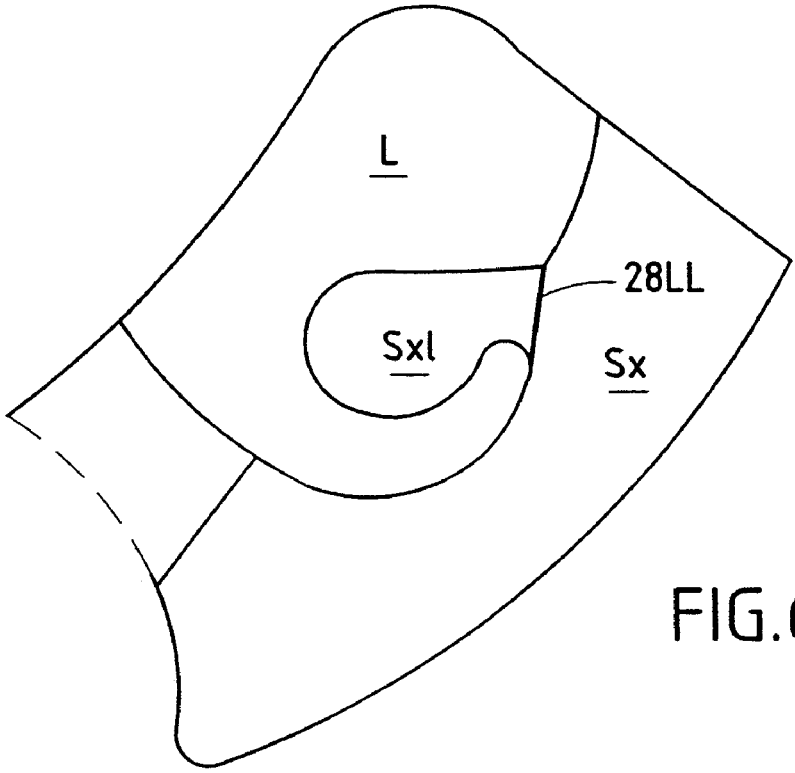
FIG. 6 shows a particular example of a stack of pieces and of a portion of skeleton that are mutually interlocking.

FIG. 6 shows an example of such a special piece L interlocking with a skeleton portion Sx. A skeleton cutting-up line 28LL is then defined that isolates the interlocking portion Sxl of the skeleton portion Sx by joining up two points on the outline of the piece L, without crossing through said piece. The location of the line 28LL may be sought automatically by defining the outline of an imaginary envelope deduced from the piece by taking the convex envelope followed on the basis of the geometrical shape of the piece. Such a convex envelope or path may be simulated by taking Bezier curves bearing on each of the segmented outline portions of the piece, and by joining them. The unit formed by uniting the piece L with the skeleton portion Sxl is then processed as if it were a single piece, the piece L and the skeleton portion Sxl being separated, e.g. manually, after said unit has been unloaded.

Figure 7:
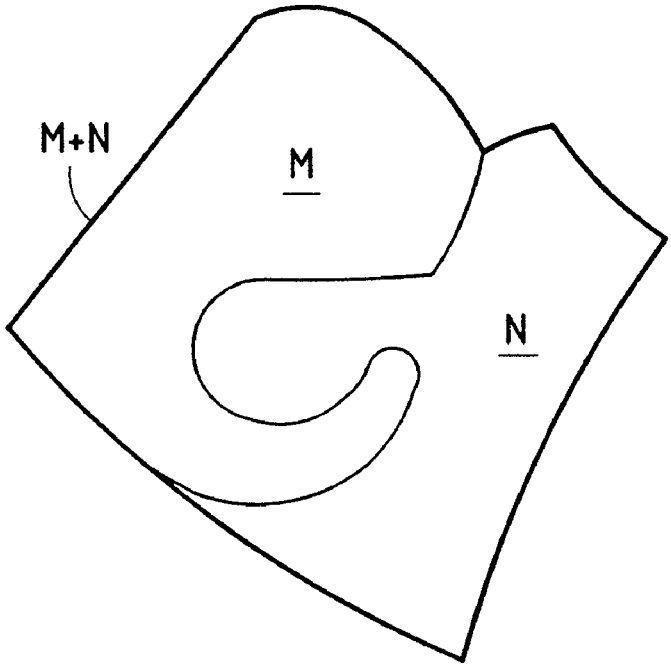
FIG. 7 shows a particular example of stacks of pieces that are mutually interlocking.

FIG. 7 shows an example of other special pieces M and N that are mutually interlocking. Since cutting across the pieces M or N is impossible, the unit M+N constituted by the pieces M and N as united is processed as if it were a single piece. The pieces M and N can be separated manually after the unloading stage.

Naturally, the principles described above apply to special pieces interlocking with a plurality of portions of skeleton and/or with a plurality of other pieces.

In the example given below, the cutting-up lines along which the skeleton is to be cut up are straight line segments that connect to the outlines of the pieces at particular points on these outlines. The term "particular points" is used in this example to mean vertices of angles or cusps or, more generally points at which the radius of curvature of the outline is very small, and less than a given value. In a variant, the cutting-up lines along which the skeleton is cut-up may be non-rectilinear, e.g. curved so as to connect to the outlines of the pieces by being tangential or substantially tangential to the outlines. Also in a variant, the connection points at which the skeleton cutting-up lines connect to the outlines of the pieces may be points other than the above-defined particular points, in particular when the outline of a piece has no such points (as is the case for a circular piece). It is then possible to choose the points on the outline that have the largest co-ordinates and those that have the smallest co-ordinates along the two axes X, Y.

A second step 403 for laying out skeleton cutting-up lines consists in defining splitting up of the edge zones of the skeleton. To this end, for each piece adjacent to one (or more) edges of the lay-up, the point that is closest to the edge (or to each edge) is sought, for example, and a cutting-up line is defined that joins said point to the edge of the lay-up, preferably perpendicularly to said edge.

For example, the various pieces of the lay-up are taken starting from the piece A that is closest to the origin O, and then row-by-row along the axis Y in alternate directions.

Figure 5B:
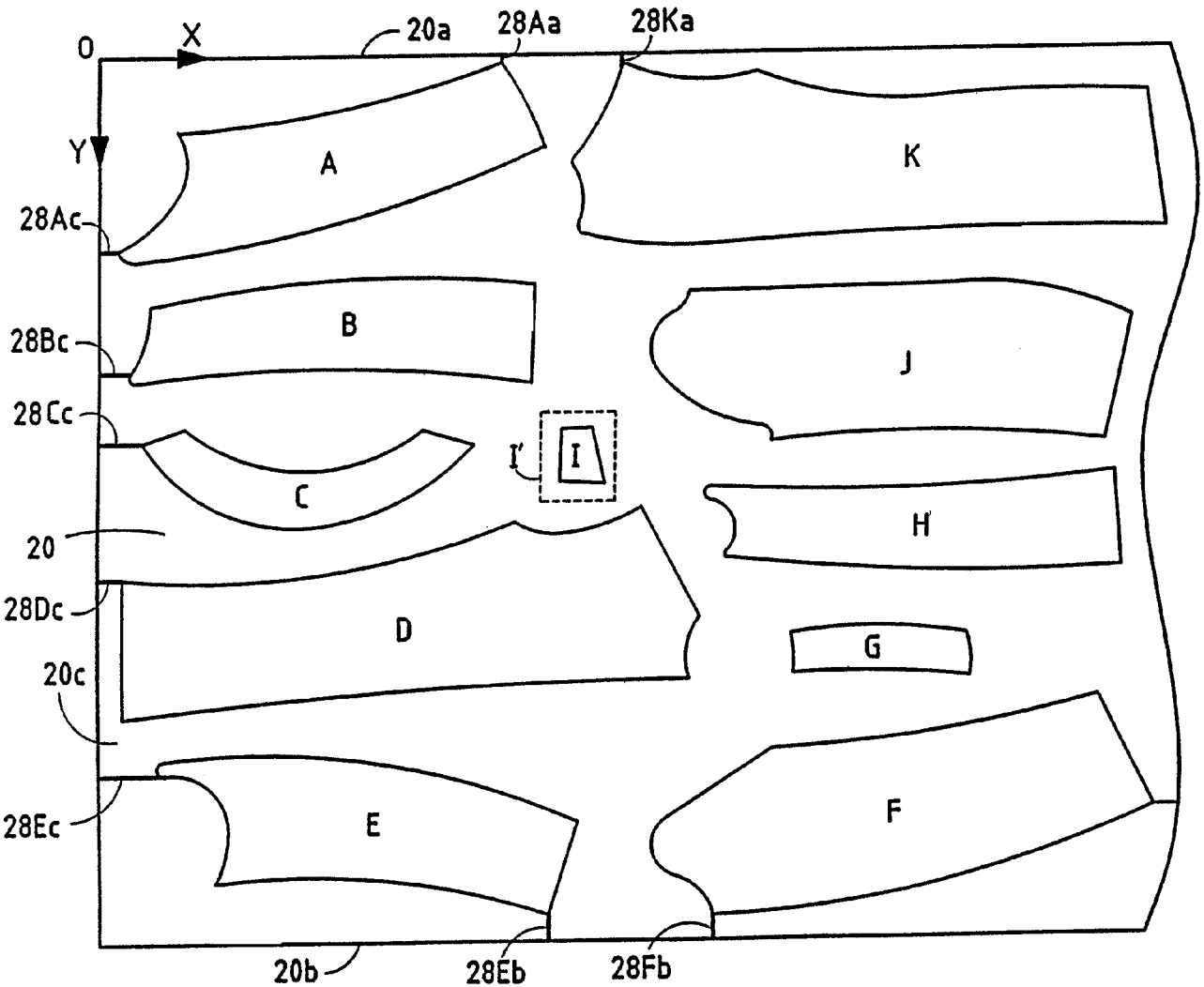

Thus, as shown in FIG. 5B, starting from the piece A, two cutting-up lines 28Aa and 28Ac are defined extending towards the edges 20*a* and 20*c* of the lay-up. Starting from the pieces B, C, and D, lines 28Bc, 28Cc, and 28Dc are defined extending towards the edge 20*c* and, starting from the piece E, two lines 28Ec and 28Eb are defined extending towards the longitudinal edge 20*b* of the lay-up that is opposite from the edge 20*a*. In the second row of pieces F to K, the lines 28Fb and 28Ka are defined from the pieces F and K to the edges 20*b* and 20*a*, the other pieces G to J not being adjacent to an edge. The splitting up of the edge zones of the skeleton for the remainder of the lay-out continues in the same way.

A third step 404 for laying out skeleton cutting-up lines consists in defining splitting-up of the inner region of the skeleton so as to achieve continuity in cutting-up from one longitudinal edge to the other, i.e. transversely relative to the longitudinal axis of the lay-up. For example, but not necessarily, it is possible to proceed row-of-pieces by row-of-pieces.

Figure 5C:
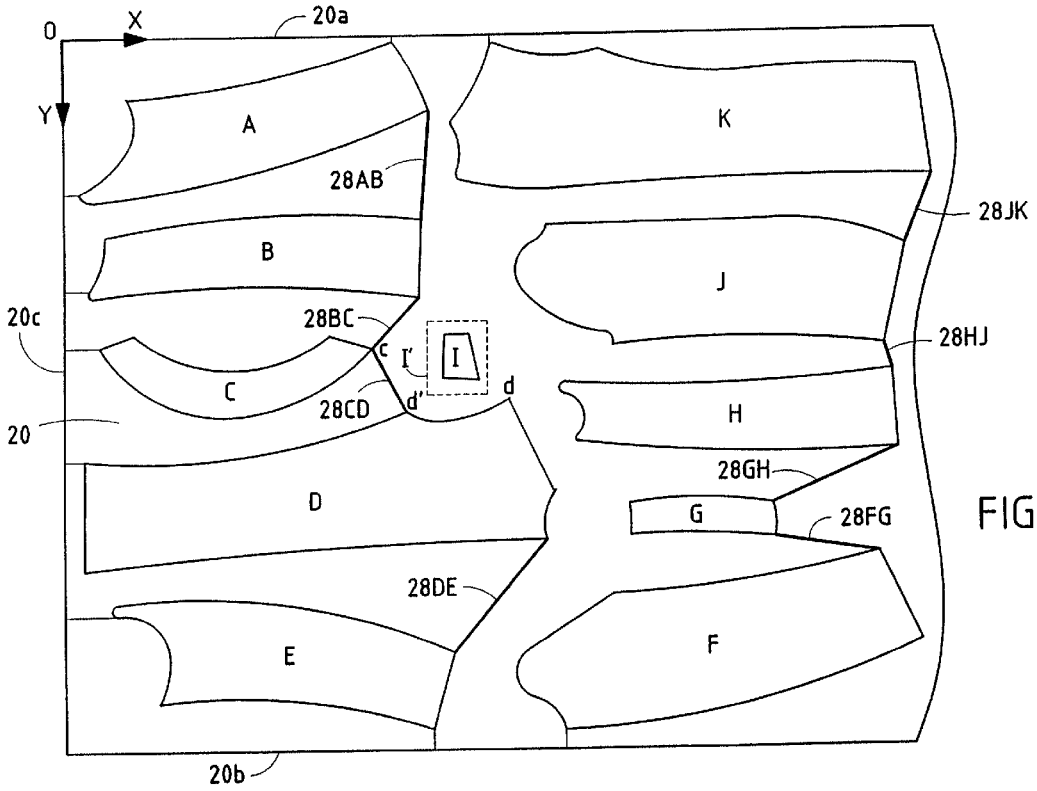

Thus, for the pieces A to E, skeleton cutting-up lines 28AB, 28BC, 28CD, and 28DE are defined that join up the outlines of the 25 pieces A & B, B & C, C & D, and D & E (FIG. 5C). In the example shown, the outlines are interconnected in this way at particular points having the highest possible value along the X axis, i.e. as far as possible from the edge 20*c*.

Naturally, a skeleton cutting-up line must not pass across a location of a piece, nor even pass at less than a minimum distance from the outlines of the pieces other than the pieces that it interconnects. That is why the interconnection between the piece C and the piece D takes place between the particular point c on the piece C and the particular point d' on the piece D, the particular point d of highest X-axis value on the piece D being inaccessible from the point c without passing across the zone I' surrounding the piece I (it is also possible to consider joining up the points c and d via a cutting-up line that is not straight and that passes wide of the location of zone 1').

Cutting-up lines 28FG, 28GH, 28HJ, and 28JK are defined in similar manner, and the following rows (not shown) are processed in the same way. It should be noted that since it is a "small piece", the piece I is not connected to an adjacent piece via a cutting-up line along which to cut up the skeleton that surrounds it.

A fourth step 405 for laying out skeleton cutting-up lines consists in defining splitting-up of the inner region of the skeleton along an axis that is longitudinal or substantially longitudinal. In the example shown, this is achieved by establishing continuity in the cutting-up of the skeleton between rows of adjacent pieces, over one or more lines, so as to define skeleton portions in which concavity is minimized, so that they are easier to handle.

To this end, it is possible in particular to eliminate "nooks" or pockets. This can be achieved, at least initially, by examining the skeleton portion situated upstream from the first row of pieces, and by searching for the vertices of the concave portions or "nooks". To take account of the facts that the number of cuts in the skeleton must be as small as possible, in order to optimize the time required to cut up the lay-up and to optimize removal of the portions of skeleton, and that the stacks of pieces and the portions of skeleton can be removed not only to the front of the lay-up but also laterally to both sides thereof, the nooks are selected and used, for example, as follows:

the vertices of nooks are sought going from one side of the lay-up (e.g. the side 20*b*) to the middle portion, and then going from the opposite side of the lay-up;

only the most marked nooks are selected, e.g. by ignoring those whose distance from an already-selected nook or from a point to which an already-laid-out cutting-up line leads is shorter than a given value; and each selected nook vertex is connected via a cutting-up line to the nearest characteristic pattern point along the X axis.

Figure 5D:
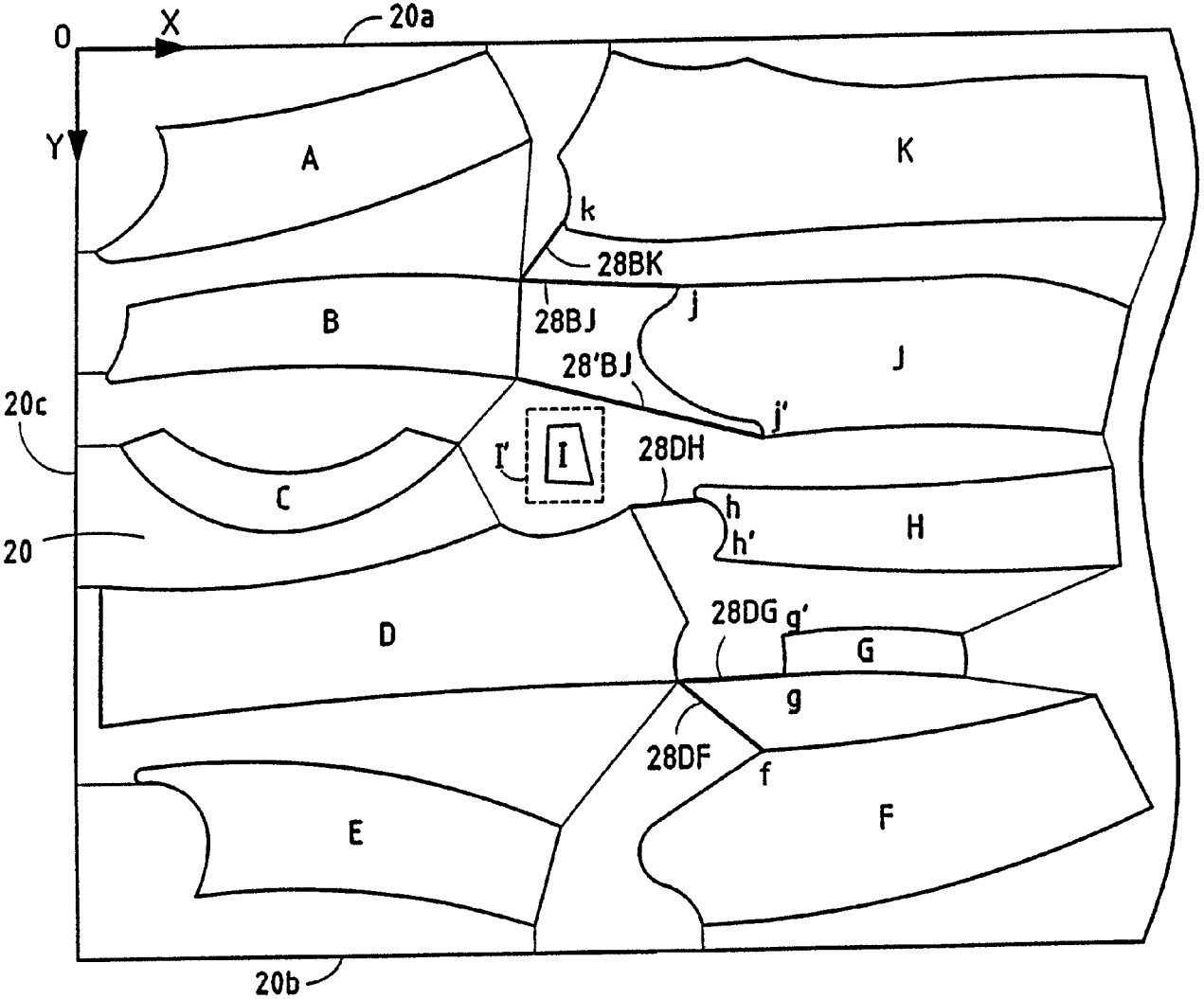

As shown in FIG. 5D, this is how the nook vertices k, i, ', h, f, and g are selected and the vertices such as g' and h' are ignored, and how the lines 28BK, 28BJ, 28'BJ, 28DH, 28DF, and 28DG are defined.

Figure 5E:
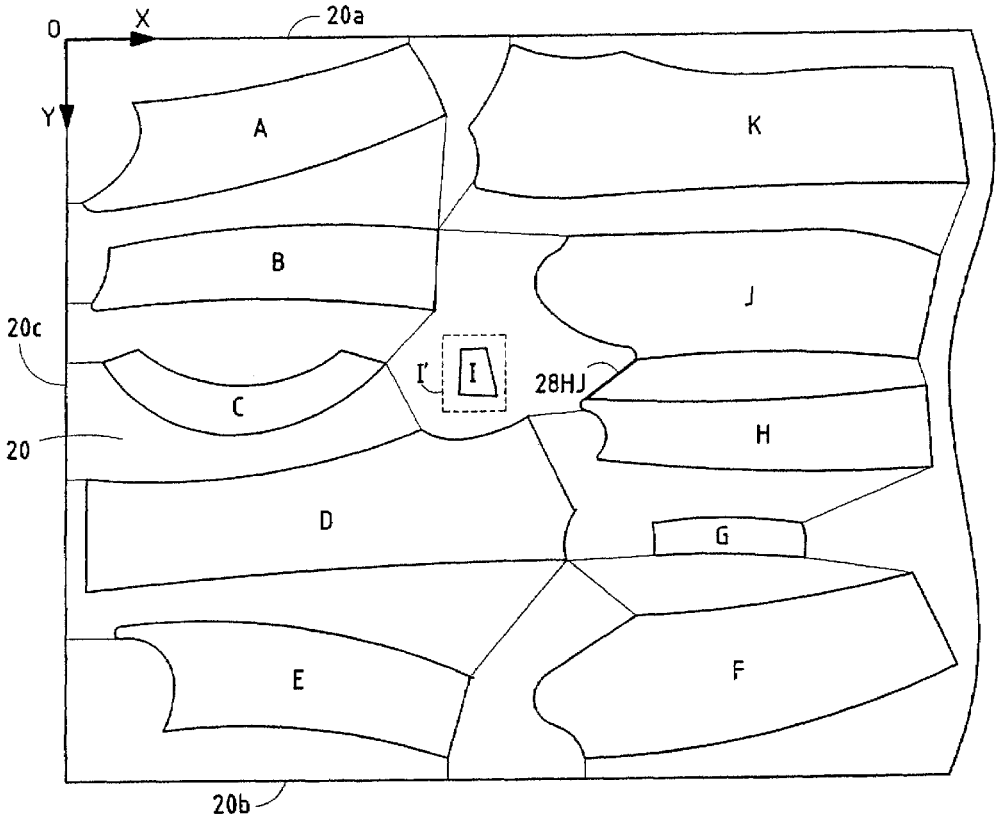

At this stage, it is possible optionally to search for whether the cutting-up lines should be defined to minimize the size of the skeleton portions in which pieces of small size are included. This can be performed by searching the surroundings of the pieces of small size to determine whether it is possible to add one or more cutting-up lines joining up particular points on outlines of pieces, and making it possible to reduce significantly (beyond a determined reduction threshold) the area of the skeleton portion in question. This search must be performed while complying with the minimum dimensions of the zones in which the pieces of small size must be included. In the example shown, this results in defining the line 28HJ, as shown in FIG. 5E in order to minimize the portion of skeleton including the piece J.

The next step 406 of the process shown in FIG. 4 consists in determining the order in which the stacks of pieces and skeleton portions are to be taken off from the lay-up and the take-off corridors that they are to follow to be unloaded to the desired location, without interfering directly or indirectly with the pieces that have yet to be taken off. This step may optionally include additional splitting up of the lay-up when taking-off is impossible otherwise.

A take-off corridor is characterized by a preferred slide direction and by a width which is determined by the geographical end limits of the piece or skeleton portion in question, in a direction orthogonal to the slide direction. The preferred slide direction may be rectilinear or otherwise, it being possible for the piece to be taken off using optionally combined movements in translation along a straight line parallel to the surface of the lay-up, and in rotation about an axis orthogonal to the surface of the lay-up.

In general, automatically searching for a take-off corridor along which to take off a piece or a skeleton portion takes account of the available area on the take-off table, of the necessity of taking off each stack of pieces of skeleton portion without interfering with the remaining pieces in the lay-up, and of the desire to find the shortest possible path to the corresponding collector device.

In the example shown (FIG. 5F), it is possible to start from that portion of skeleton S1 which is closest to the origin O. A take-off corridor may be found in the slide direction dS1 (shown in part only). The search then continues by examining successively the pieces and skeleton portions A, S2, B, S3, C, S4 situated along the edge 20*c* of the lay-up, and by determining the slide directions dA, dS2, dB, . . . For each piece or skeleton portion for which a take-off corridor has been found, a take-off rank is noted (the skeleton portion S1 has the rank 1, the piece A has the rank 2, the skeleton portion S2 has the rank 3, the piece B has the rank 4, and so on).

When the piece D is reached, it is observed that said piece cannot be taken off. The search then moves on to the following pieces and skeleton portions until the skeleton portion S6 adjacent to the edges 20*c* and 20*b* is reached, which portion is the next one for which a take-off corridor can be found. Moving on from the skeleton portion S6, the remaining skeleton portions are examined, always with priority being given to those closest to the edge 20*c*, thereby making it possible to find take-off corridors and slide directions for the pieces and skeleton portion E, S5, and D.

The search is then continued starting from the piece or skeleton portion that is closest to the front edge of the lay-up (in this example, the skeleton portion including the piece 1).

Figure 5F:
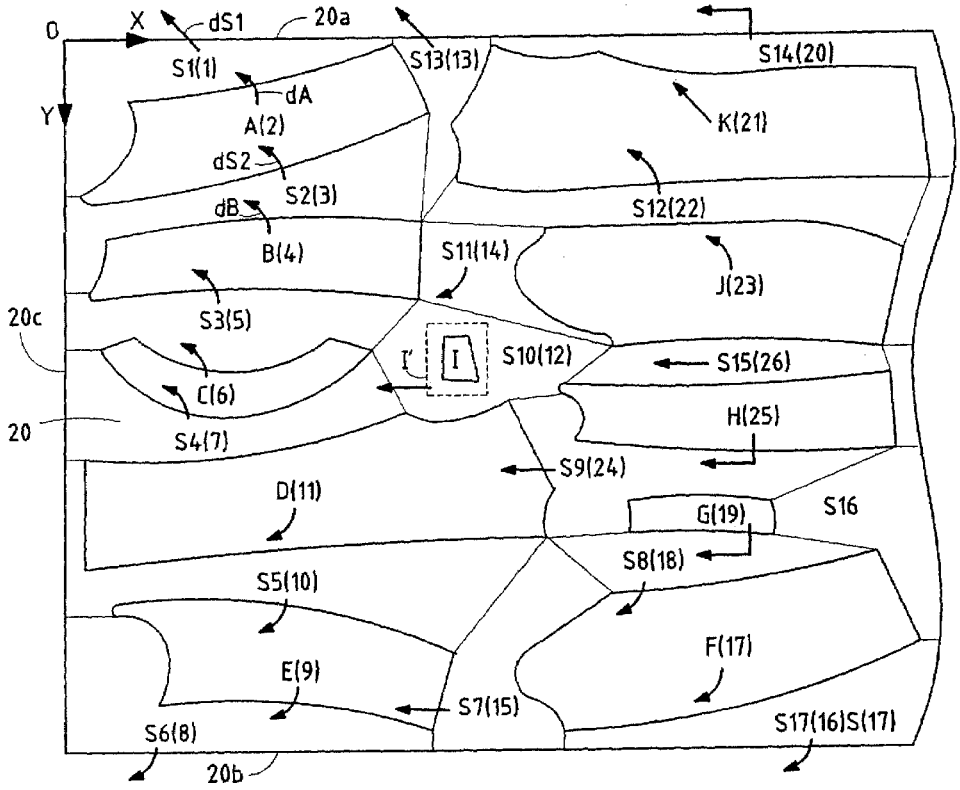

For each piece or skeleton portion, FIG. 5F diagrammatically shows the initial portion of the slide direction and, in parentheses, the take-off rank.

In the above, consideration is given to determining a take-off corridor for each skeleton portion. However, for skeleton portions reduced to fragments of small size, e.g. of area smaller than a given minimum value, it is possible to omit determining take-off corridors since such fragments are not liable to hinder unloading and removal of the stacks of pieces and of the other portions of skeleton.

The locations and shapes of the cutting-up lines 28 constitute skeleton fragmentation information which is stored in the computer 18 with piece lay-out information for subsequently controlling the cutting tool (step 407).

Unloading and removal information is also stored in the computer (step 408), which information is associated with the stacks of pieces 24 and with at least certain portions 29 of skeleton; each item of information comprising:

an unloading or removal rank;

an item of pick-up information relating to that location on the surface of the stack of pieces or of the skeleton portion to which the axis of the unloading tool is to be brought (this location may be the center of gravity of the surface of the stack of pieces or skeleton portion);

take-off information comprising information relating to the slide direction to be followed by the stack of pieces or skeleton portion, including any rotation that should be imparted to it, to enable the stack of pieces or skeleton portion to be taken off from the lay-up without interfering with the stacks of pieces that are not yet unloaded, and by moving only parallel to the unloading table; and an unloading or removal address that identifies the location to which the stack of pieces or skeleton portion is to be unloaded, i.e. the co-ordinates of the device for collecting said stack of pieces or for removing said skeleton portion.

Implementing Unloading

Figure 8A:
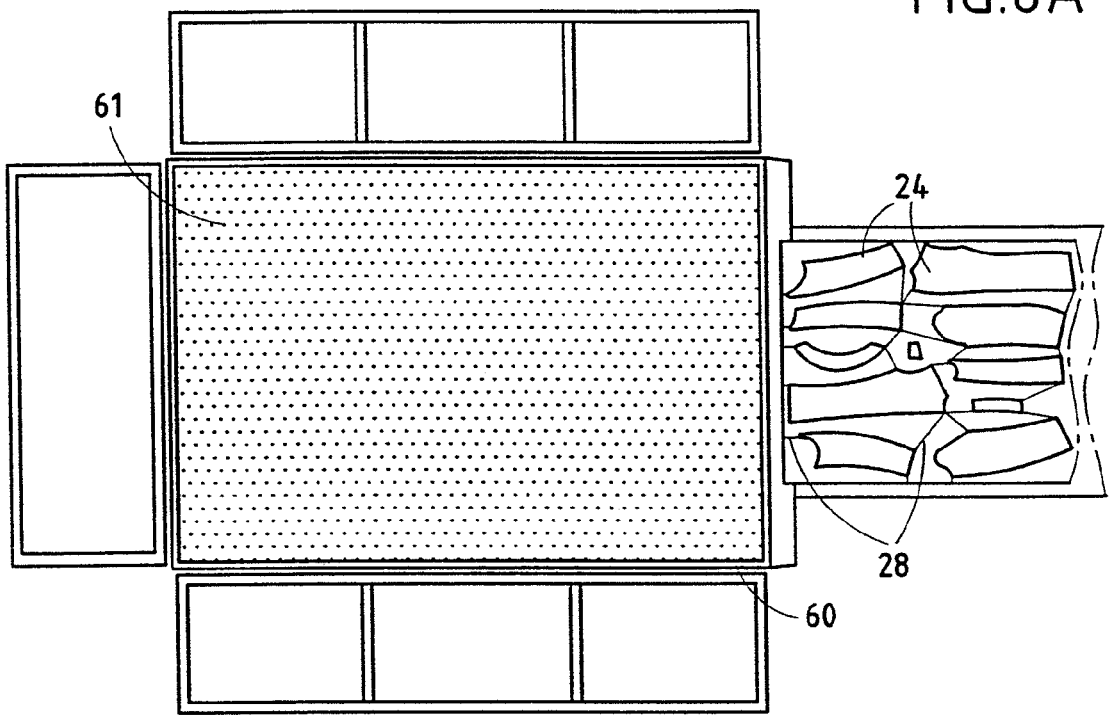
FIGS. 8A to 8D show various stages of an automatic process for cutting out stacks of pieces and fragmenting the remaining skeleton from a lay-up, and for unloading stacks of lay-up pieces and removing fragments of lay-up skeleton, for implementing the method as in the implementation shown in FIGS. 5A to 5E.

FIG. 8A shows an example of stacks of cut-out pieces 24 and of cut-up lines 28 formed in a lay-up in compliance with the piece layout and skeleton fragmentation layout information, as in the example shown in FIGS. 5A to 5E.

The-lay-up 20 is advanced;-and its cut-up portion reaches the surface 61 of the unloading table 60.

The stacks of pieces are unloaded and the skeleton portions are removed by controlling the unloading tool on the basis of the unloading and removal information, using a pre-established process, as described above with reference to FIG. 5F. The unloading may be performed at the end of a stage during which the lay-up is caused to advance, or during said stage.

Figure 8B:
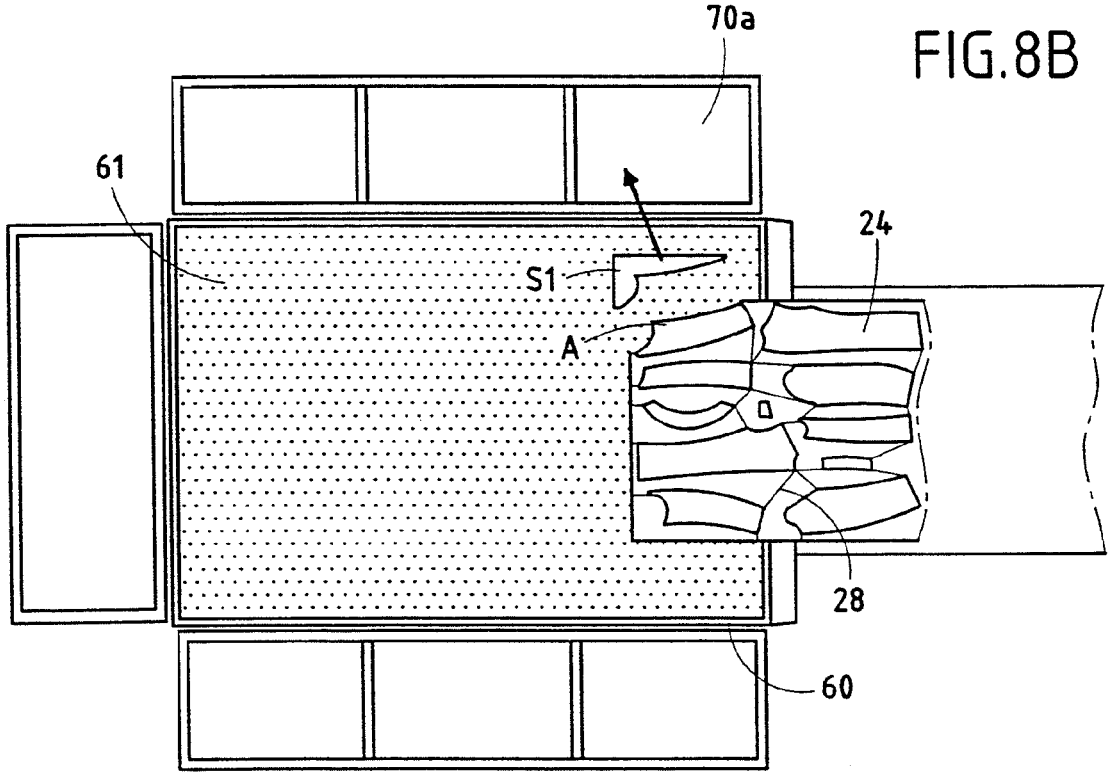

FIG. 8B shows how the first skeleton portion S1, situated at the downstream end of the lay-up, is moved to the removal bin 70*a*.

Figure 8C:
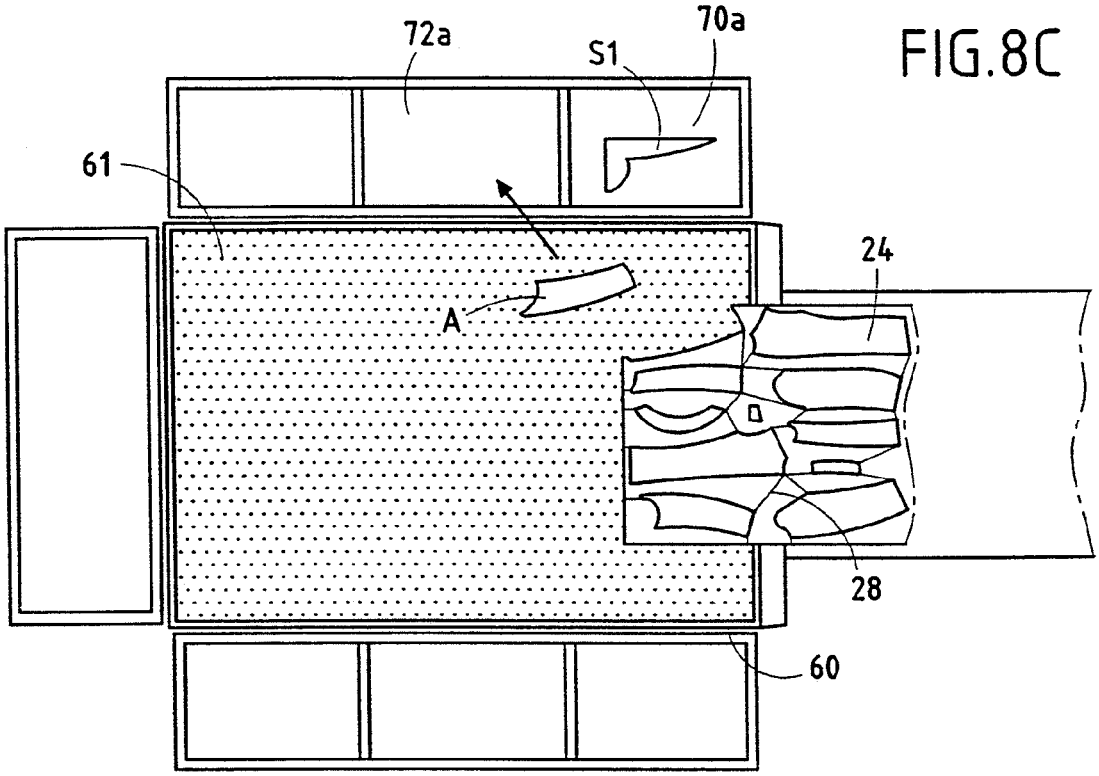

FIG. 8C shows how the first stack of pieces A is moved, the removal of the first skeleton portion having made it possible to take off said stack of pieces without interfering with the remainder of the lay-up. The stack of pieces A is brought by the unloading tool to the collector bin 72*a*.

Figure 8D:
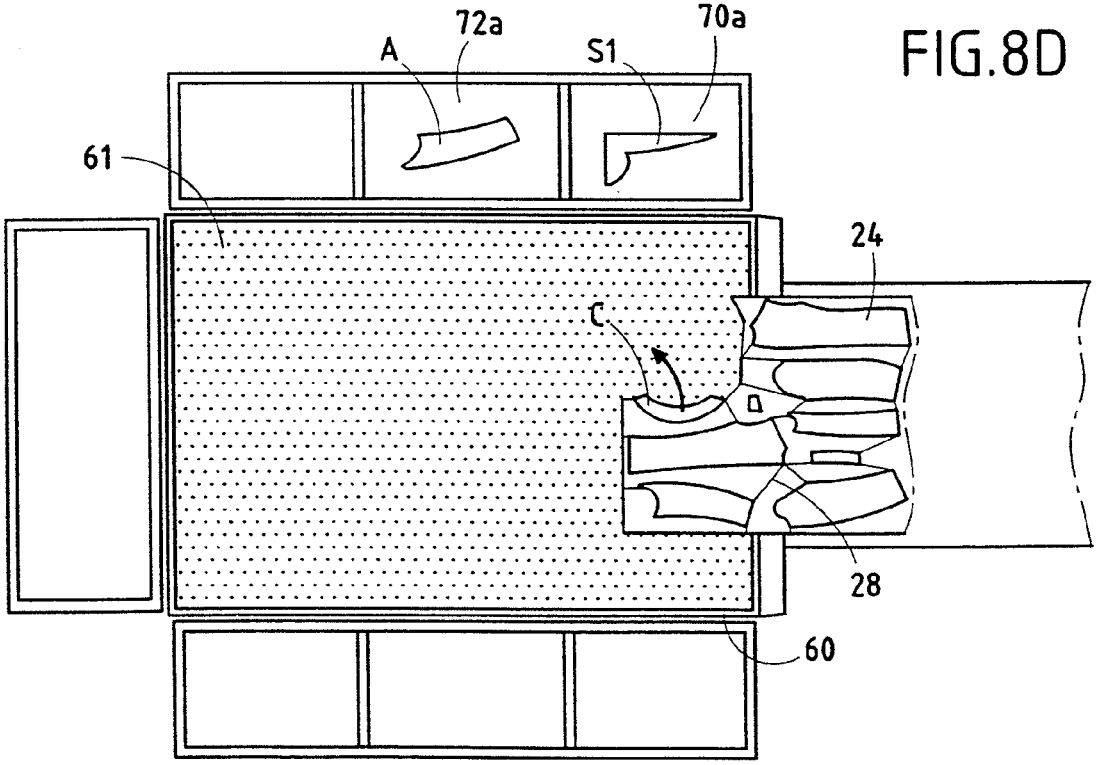

FIG. 8D shows the movement imparted to the stack of pieces C at a subsequent stage of the unloading. This stack is unloaded by causing it to turn it about its own axis at the start of its unloading corridor, by turning the unloading tool about its axis which is situated at the pick-up location on the stack of pieces.

Each stack of pieces is driven merely by contact between the unloading tool which is caused to move, and the top surface of the stack of pieces or portion of skeleton. To this end, the unloading tool is brought in the raised position to vertically above the pick-up location, and it is then lowered to come to bear against the stack of pieces or portion of skeleton. At the same time, a cushion of air is established at the surface of the unloading table so that it is possible to move the stack of pieces or skeleton portion parallel to the surface of the table without friction.

Variants

The link between each stack of pieces or skeleton portion and the unloading tool may be reinforced by providing said tool with a needle that penetrates into the stack of pieces or portion of skeleton to a limited depth when the cup is brought into the lowered position in contact with the stack of pieces.

In addition, as described above, it is considered that each stack of pieces or portion of skeleton is accompanied by the unloading tool to the corresponding bin. In a variant, the take-off and removal information may be used to control the unloading tool firstly to take off the stack of pieces or skeleton portion completely from the lay-up, and secondly to impart sufficient movement for the stack of pieces or skeleton portion to move on its own to the chosen bin. The movement may be imparted by causing the tool to accelerate over a limited distance in the suitable direction. The unloading rate can thus be increased, since the movements of the unloading tool are smaller.

It may be desirable for the fraction of film 30 cut-out with and overlying each of the stacks of cut-out pieces recovered in the bins to be removed.

Figure 9:
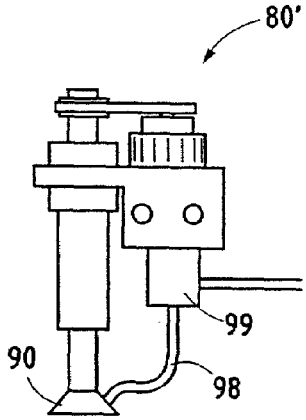
FIG. 9 is a diagrammatic elevation view showing another embodiment of an unloading tool for an installation of the invention.

To this end, an unloading tool 80' as shown in FIG. 9 is advantageously used. The tool 80' differs from the tool shown in FIG. 3 only by the fact that the cup 90 is connected to suction means (not shown) via flexible pipe 98 provided with a valve 99.

Figure 10:
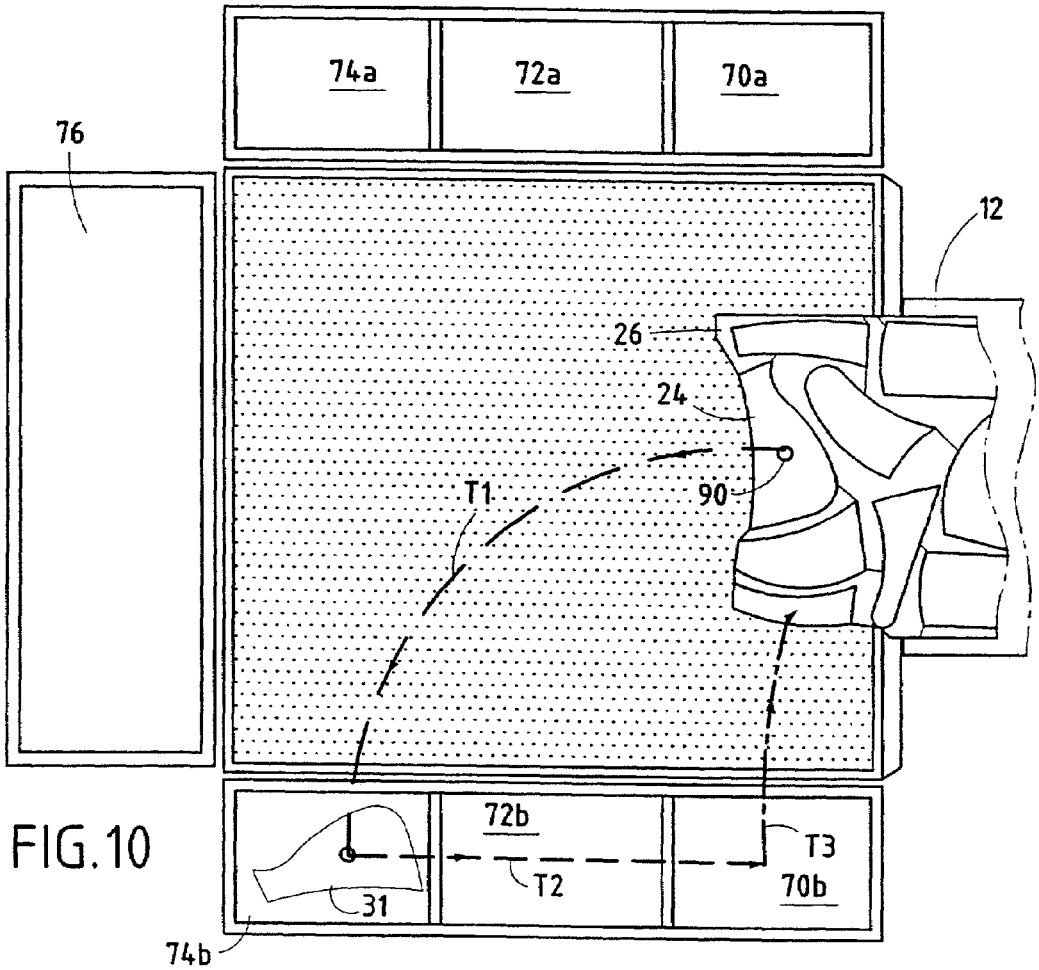
FIG. 10 shows the successive steps of unloading a stack of pieces and of removing a portion of plastics film initially situated above the stack of pieces, by means of the unloading tool shown in FIG. 9.

The valve 99 is opened to put the cup under suction after the unloading tool is applied against the pick-up location on a stack of pieces 24 to be unloaded and before it arrives above the corresponding bin, e.g. 74*b*, by following the path $T_1$ (FIG. 10). Under the effect of the suction, the fraction 31 of airtight film remains in contact with the cup 90 after the pieces have fallen into the collector bin, and it can be brought to a removal bin, e.g. the bin 70*b* for removing skeleton fragments from the lay-up, by guiding the unloading tool over a path $T_2$ between the bins 74*b* and 70*b*. When the tool has arrived above the bin 70*b*, the valve 99 is closed, thereby interrupting the suction and releasing the fraction 31 of film. The tool is then brought in the raised position to vertically above a new stack of pieces to be unloaded (path $T_3$) or vertically above a fragment of lay-up skeleton to be removed.

Figure 11:
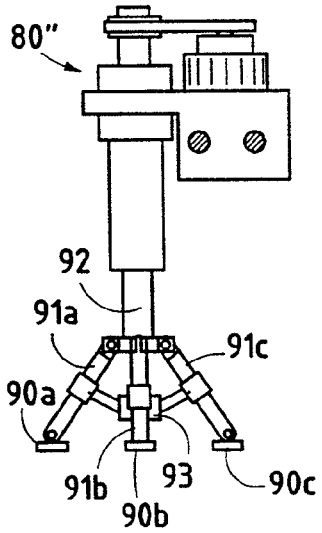
FIG. 11 is a diagrammatic elevation view showing a third embodiment of an unloading tool of an installation of the invention.

FIG. 11 shows another embodiment of an unloading tool 80" which differs from the embodiment shown in FIG. 3 in that, instead of being terminated by a cup, the rod 92 is terminated by a set of a plurality of fingers, e.g. three fingers 90*a*, 90*b*, 90*c*. The fingers are at the ends of hinged arms 91*a*, 91*b*, 91*c* which can pivot relative to the end of the rod 92 so as to adjust the mutual spacing between the fingers. The arms. 91*a*, 91*b*, 91*c* are pivoted individually or together by drive means 93 controlled by the computer 18.

This embodiment of the unloading tool makes it possible, for skeleton portions of large size, for the unloading tool to bear against various zones distant from one another on the surface of the stack of pieces or skeleton portion, the co-ordinates of the pick-up location still corresponding to the axis of the rod 92. The stack of pieces or skeleton portion can then be moved along its take-off path and optionally turned about its own axis more reliably.

In the above, it is considered that the skeleton portions are accompanied towards the removal bins by the unloading tool by causing said tool to move along a predetermined path. This is possible and justified when the portions of skeleton are of relatively large size and must be removed from the unloading table in order to avoid hindering the unloading of the pieces.

However, it is possible, after cutting-up, for there to remain small fragments of skeleton whose presence on the unloading table does not present any real obstacle to unloading the pieces, even if they lie in the paths of said pieces.

It remains desirable to remove such fragments, ether periodically or at the end of the process of unloading all of the pieces in a lay-out. This may advantageously be performed by sweeping the unloading table.

Figure 12:
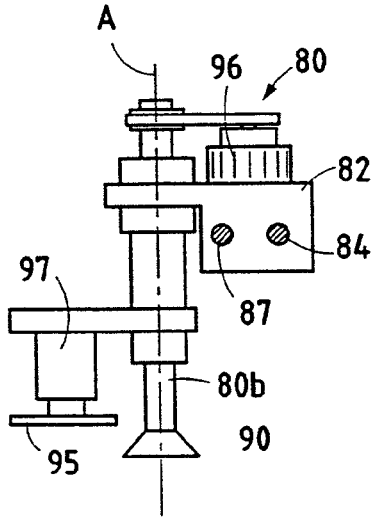
FIG. 12 is a diagrammatic elevation view showing a fourth embodiment of an unloading tool provided with sweeping means, for an installation of the invention.

To this end, as shown in FIG. 12, the unloading tool 80 may be provided with a retractable sweeping device, e.g. a sweeper blade 95. The sweeper blade is mounted at the end of an actuator 97 supported by a plate secured to the rod 92.

With the cup 50 in the raised position, the scraper 95 can be lowered into the immediate vicinity of the surface of the unloading table by means of the actuator 97. The carriage 82 is then caused to move and the rod 92 is caused to rotate on the basis of a pre-established program for sweeping the surface of the unloading table and for removing the fragments of skeleton to either one of the removal bins 70*a*, or 70*b*.

In a possible variant, to remove small fragments of skeleton, it is possible to provide the unloading tool 80 with a retractable needle situated on the axis A of the tool. As lowered, the needle can project beyond the cup 90 so as to come into contact with the surface of a small fragment of skeleton to be taken off from the lay-up, and can remove the fragment by the tool being moved, provided that it is not necessary to turn the fragment.

Figure 13:
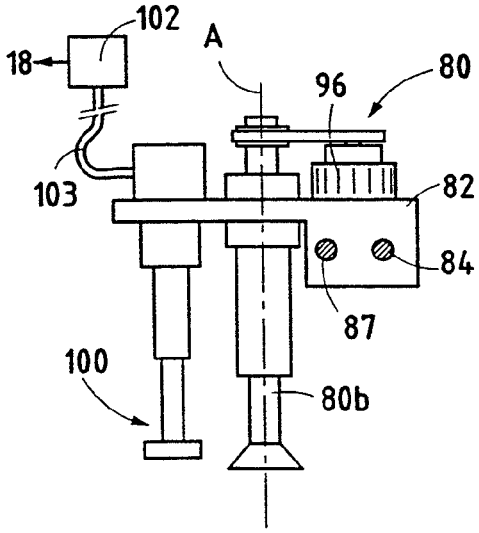
FIG. 13 is a diagrammatic elevation view of a fifth embodiment of an unloading tool provided with printing means, for an installation of the invention.

In the embodiment shown in FIG. 13, the unloading tool 80 e.g. identical to the tool of FIG. 3, is associated with printing means 100 mounted on the tool support 82. In this way, the stacks of pieces taken off from the lay-up can be identified by marking their top surfaces on the cut-out portion of film 30 in order to facilitate subsequent processing of the stacks. The printing may be performed while the stacks of pieces are being moved by means of the unloading tool. The stacks of cut-out pieces are then removed without the fractions of film 30 being removed from them.

For example, the printing means 100 may be constituted by an ink jet print head of commercially-available known type. The 5 flexible pipe for feeding the head 100 with ink and the conductors for conveying the control signals for emitting the ink jet, and the signals for powering the jet deflector plates are received inside a flexible umbilical cord 103 connecting the head 100 to its control unit 102. The control unit 102 is connected to the computer 18.

To perform the marking, the print head 100 is controlled by the computer 18 as a function of data relating to the information to be marked and to a marking format. The type of the characters to be printed is determined by the information to be marked, and the size of the characters is determined by the marking format.

The information to be marked and the marking format are pre-recorded in the memory of the computer 18 with reference to the stacks of pieces to be unloaded. The marking format depends on the sizes of the pieces.

Figure 14:
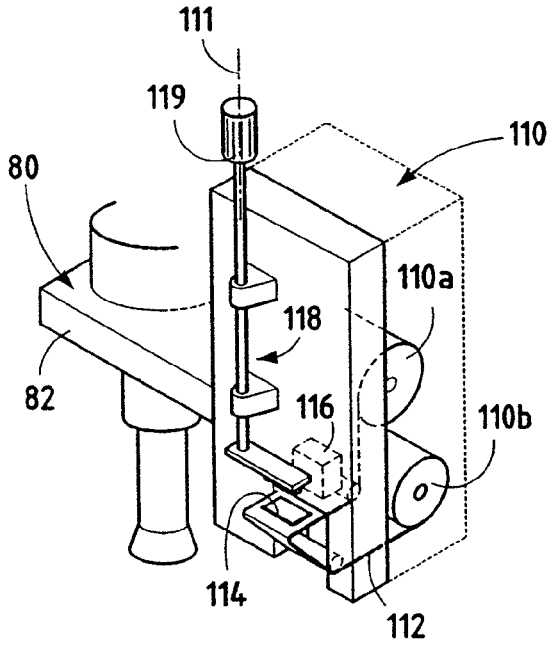
FIG. 14 is a diagrammatic elevation view of a sixth embodiment of an unloading tool provided with labelling means, for an installation of the invention.

In the embodiment shown in FIG. 14, the unloading tool 80, e.g. identical to the unloading tool shown in FIG. 3, is associated with labeling means 100 mounted on the tool support 82. The labeling means 110 may be constituted by a commercially-available known type of label machine.

In the example shown, the labeling machine 110 contains a paper tape 112 or analogous backing on which removable self-adhesive labels 114 are fixed. The tape 110 carrying the blank labels is paid out from a dispenser roller 110*a* and is brought successively past a print head 116 and past a label-taking and label-applicator device 118 before being wound back up on a collector roller 110*b*.

The print head 116, e.g. of the thermal type or of the ink jet type, makes it possible to print labels as and when they are required.

The label-taking and label-applicator device 118 comprises an applicator actuator 118 whose rod is provided at its end with suction cups making it possible to take printed labels by peeling them off from the backing 112. The applicator actuator 118 is mounted to rotate about a vertical axis 111 in order to take off each label to be applied and in order to present it in any desired angular position. The actuator 118 is rotated by a motor 119.

By transmitting the necessary signals to the labeling machine via a cable (not shown), the computer 18 controls: operation of the labeling machine 110, in particular the rotation of the dispenser roller and of the collector roller, in order to bring the labels successively into the print position and into the application position; operation of the integrated print head 116; taking of the printed labels to be applied; angularly positioning the label-applicator actuator 118 about the axis 111; and actuating the applicator actuator 118.

Marking devices other than labeling machines or ink jet print heads may be used, e.g. devices for printing on the film 30 by applying heat.

In order to reduce the unloading time, by optimizing the time for which the unloading tool is used, dedicated means may be provided for taking off the portions of skeleton and for removing them, in particular the portions situated along the longitudinal edges of the lay-up.

Thus, FIG. 15 shows a variant embodiment of the unloading station, in which two removal tools 120*a*, 120*b* are provided, on respective sides of the unloading table 60, at its upstream end 60*a* whose width is substantially equal to the width of the cutting table.

Each removal tool (FIGS. 15 and 16) comprises a horizontal arm 122 mounted to pivot via one of its ends on the top of a support under the action of a motor 124. The arm 122 may be a telescopic arm, e.g. constituted by an actuator. At its other end, the arm 122 carries a vertical telescopic rod formed by an actuator 126 and provided at its end with a cup-shaped piece 128, e.g. made of rubber. The motor 124 and the actuator 126 are controlled by the computer 18 to bring the cup 128 vertically above and then into contact with the pick-up locations on the successive portions of the skeleton of the lay-up that are situated along the longitudinal edges of the lay-up that reaches the unloading table, and then to remove these fragments by bringing them into an adjacent removal bin 71*a* or 71*b*.

When unloading the stacks of pieces, it may be advantageous to wrap them individually in order to prevent them from coming apart, which would complicate subsequent use of the unloaded pieces.

Figure 17:
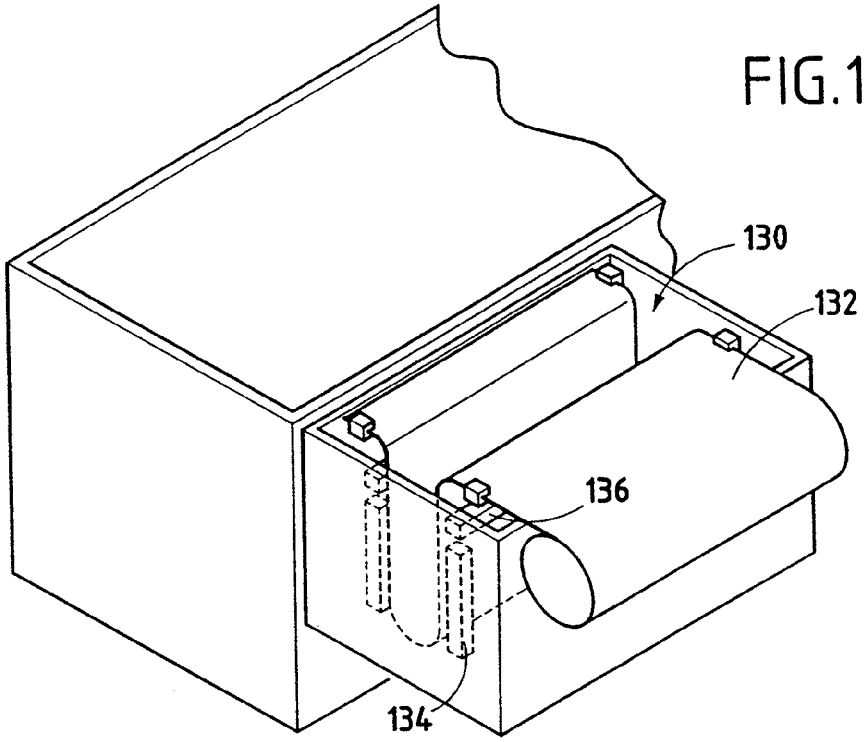
FIG. 17 is a perspective diagrammatic view showing yet another embodiment of an unloading station of an installation of the invention, with means for wrapping stacks of cut-out pieces.

To this end, each collector bin may be provided with a bagging device 130 (FIG. 17). For example, this device comprises a liner 132 of heat-sealable plastics material. Each stack of pieces is unloaded into the liner 132 associated with the corresponding collector bin, and said liner is closed by heat-sealing, and is then cut off by means of heater tools 134, 136 in a manner that is well known per se.

The wrapped stacks of pieces may be marked by means of a marking device placed immediately at the outlet of the bagging device. Marking the stacks of pieces does not then require printing or labeling means to be mounted on the support of the unloading tool, and the fractions of film 30 overlying the stacks of pieces can be removed, unlike what happens in the embodiments of FIGS. 13 and 14.

The wrapped stacks of pieces may be marked by means of an ink jet printer device or of a labeling machine that are similar to those described with reference to FIGS. 13 and 14.

The stacks of pieces may be unloaded by grouping together the stacks in different collector bins, e.g. the bins 72*a*, 72*b*, 74*a*, 74*b*, 76 of the installation of FIGS. 1 and 2, as a function of the subsequent use of the pieces.

In a variant embodiment, the stacks of pieces, or at least some of them may be deposited in a predetermined order on a transporter device, e.g. a conveyor, which conveys them to a manufacturing workshop. The order in which the stacks of pieces are deposited on the conveyor is advantageously determined as a function of the sequence in which they are to be used in the manufacturing workshop.

Figure 18:
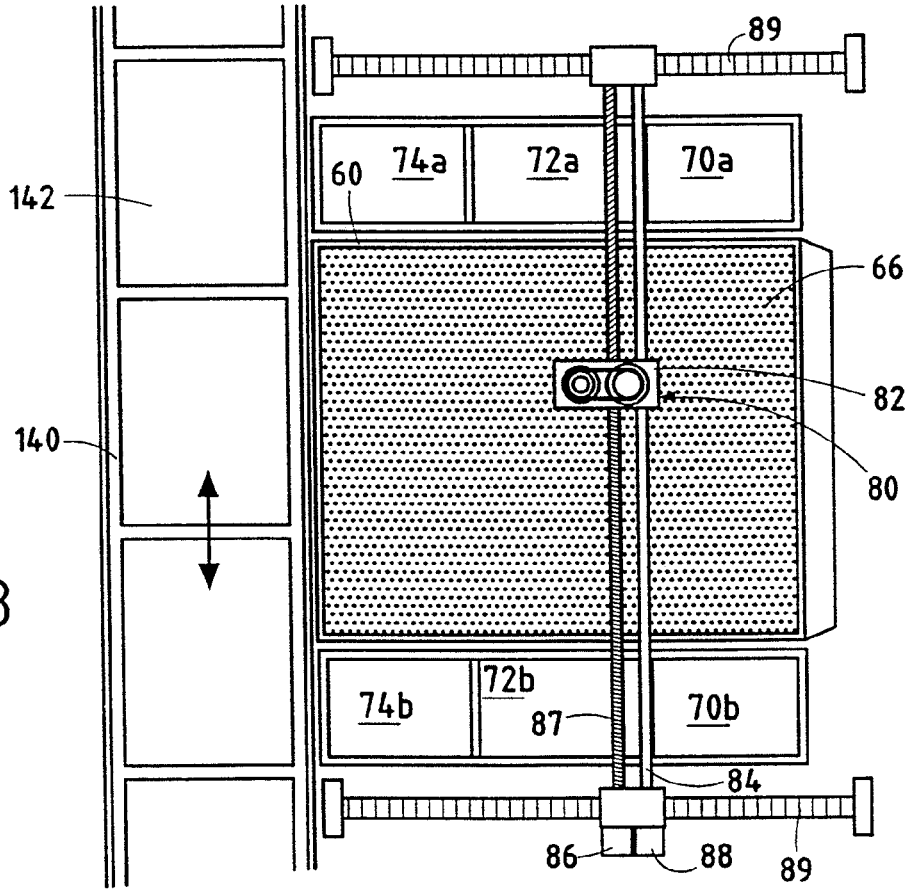
FIG. 18 to 20 are very diagrammatic views showing yet other embodiments of an installation of the invention.

Thus, FIG. 18 is a plan view showing an unloading zone which differs from the unloading zone shown in FIGS. 1 and 2 in that the collector bin 76 situated along the downstream end of the unloading table is replaced with a conveyor 140.

The conveyor 140 is advantageously provided with collector wells 142 juxtaposed along its longitudinal axis. It is moved by drive means (not shown) controlled by the computer 18, and it moves through the unloading zone parallel to the downstream end of the table 60 in both directions.

Each stack of pieces to be unloaded onto the conveyor 140 is unloaded into the desired well 142 by moving the unloading tool 80 and by positioning the conveyor 140 as a function of the unloading address specified for the stack of pieces.

In another variant embodiment, the means for collecting the stacks of pieces removed from the unloading table may comprise one or more trolleys provided with shelves.

Figure 19:
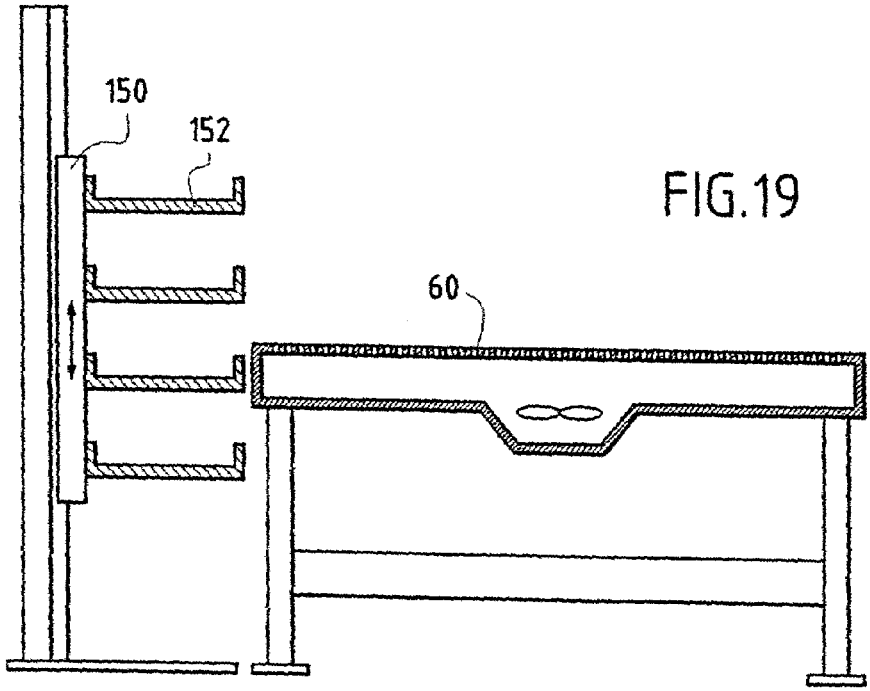

Thus, FIG. 19 is a very diagrammatic view in elevation and in section showing an unloading zone that differs form the unloading zone of FIGS. 1 and 2 in that the collector bin situated along the downstream side of the unloading table 60 is replaced with a trolley 150 provided with a plurality of superposed compartments 152. The trolley 150 is mounted to move vertically under the action of drive means (not shown). The vertical position of the trolley 150 is controlled by the computer 18 so as to select the compartment 152 to which a stack of pieces is to be removed.

Figure 20:
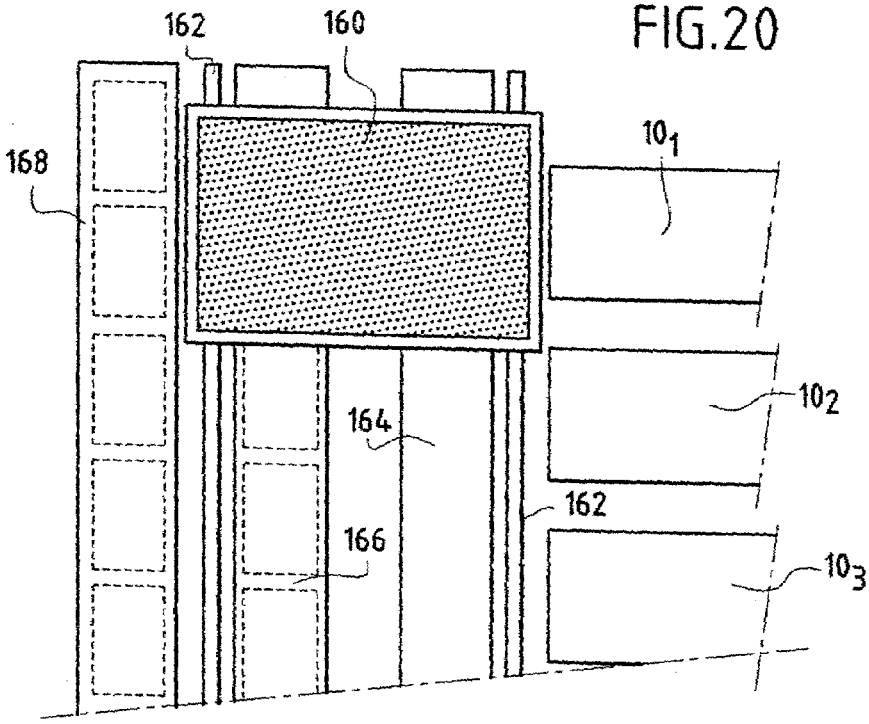

FIG. 20 is a very diagrammatic plan view showing yet another embodiment of an installation of the invention.

This installation comprises a plurality of cutting tables $\mathbf{10}_1$, $\mathbf{10}_2$, $\mathbf{10}_3$, . . . disposed parallel to one another. An unloading table 160 is mounted to move on rails 162 parallel to the axis Y of the cutting tables so as to be brought into alignment with any selected one of the cutting tables.

The means for removing the stacks of pieces and fragments of skeleton advantageously comprise conveyors that extend all the way along the path of the unloading table, parallel to the rails 162. Thus, a conveyor 164 passes under the unloading table at its upstream end for collecting the fragments of skeleton, while another conveyor 166 extends along the downstream end of the unloading table to collect the stacks of pieces. At least one additional conveyor 168 may be provided passing under the unloading table, e.g. under its middle portion, to collect stacks of pieces. The conveyors 164, 166, 168 are moved by drive means (not shown) controlled by the computer 18. The conveyors 166 and 168 may be provided with compartments or wells in the same way as the conveyor 140 shown in FIG. 18 so as to distribute the stacks of pieces therein in predetermined manner.

Figure 21:
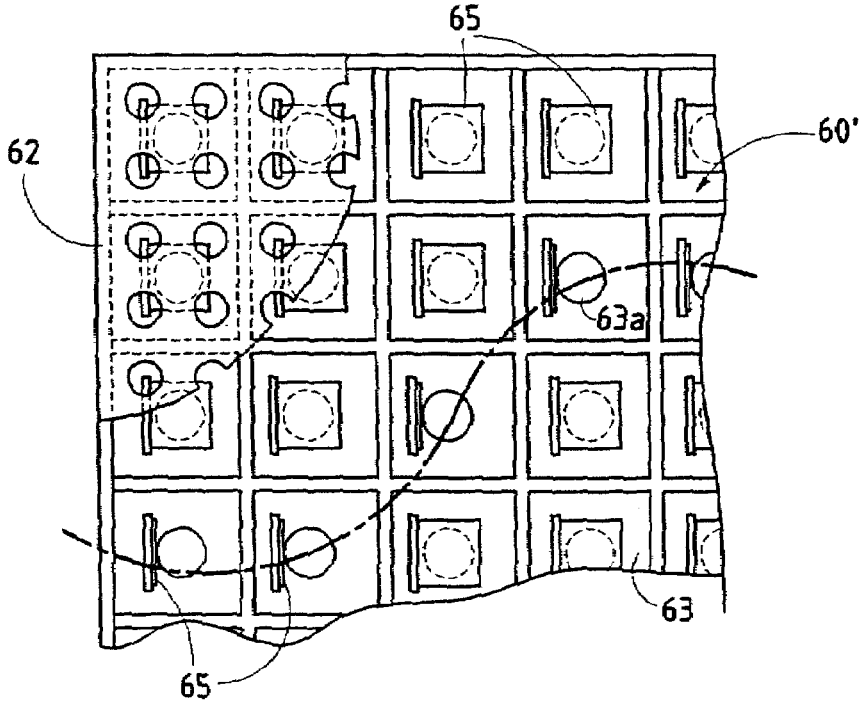
FIGS. 21 and 22 are very diagrammatic plan views showing other embodiments of an unloading table.

FIG. 21 is a very diagrammatic view of a variant embodiment of the unloading table 60' which differs from the unloading table shown in FIGS. 1 and 2 in that the case 62 is compartmentalized.

The surface of the table 60' is subdivided into a plurality of zones, each of which corresponds to a respective compartment 63 of the case 62. The compartments are connected individually to the blower means via inlets 63*a* provided with flaps 65. The flaps 65 are controlled individually by the computer 18 so as to be moved from an open position to a closed position, or vice versa.

Selectively feeding air under pressure into the compartments 63 by actuating the flaps 65 makes it possible to generate an air cushion in localized zones of the surface 61. For each stack of pieces or portion of lay-up skeleton to be unloaded or to be removed, it is then possible to limit the generation of an air cushion to the zones lying in the path of the stack of pieces or of the fragment of skeleton. This results in a significant energy saving being achieved.

In addition, since the pieces not yet unloaded are not subjected to or are not subjected in full to an air cushion, their positions on the unloading table are less likely to be disturbed.

It should be noted that the segmentation of the blower table 60' with a localized air cushion being generated should not be performed during the phases in which the lay-up advances over the table, in order to avoid disturbing the advance.

Figure 22:
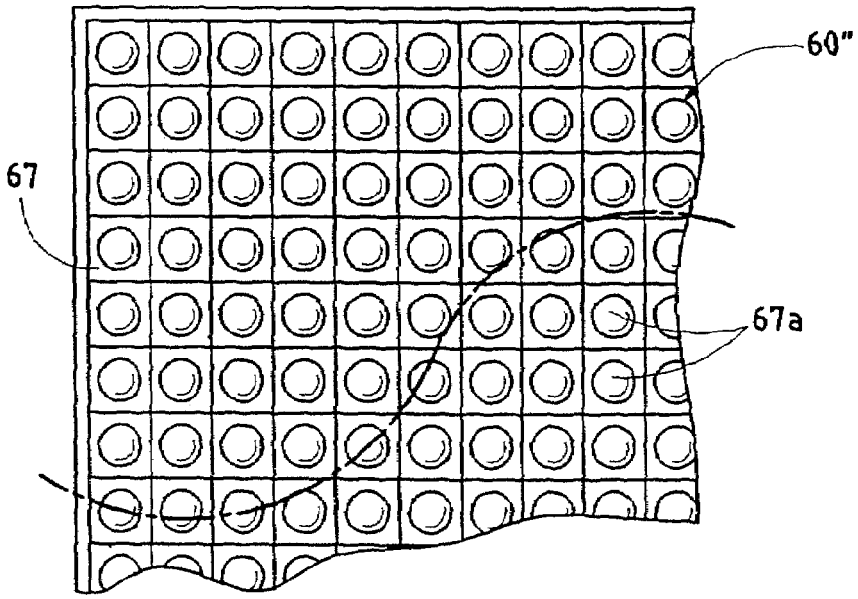

FIG. 22 shows yet another embodiment of the unloading table 60" which differs from the table shown in FIGS. 1 and 2 in that its surface is formed by a mat of beads 67, and blower means are not provided.

The stacks of pieces to be unloaded and the fragments of skeleton to be removed are moved by causing them to roll on the beads 67*a* of the mat, the beads being mounted freely in recesses of corresponding shape so that they project slightly from the surface of the table 60". In this way, the friction on the table is very low and the stacks of pieces and fragments of skeleton can, as described above, be moved by a tool that merely bears against their tops.

In the above description, consideration is given to cutting out pieces from a lay-up formed of stacked-up layers of woven fabric. As already indicated, the invention is also applicable in fields other than the clothing field, e.g.-for cutting up woven fabrics for furniture or for automobile upholstery, or for cutting up technical textiles in other fields of industry. Furthermore, although the invention is described with reference to cutting out and unloading stacks of pieces cut out from a plurality of superposed layers of flexible sheet material, it also applies when the cutting out is performed from a single layer of sheet material, the lay-up then being reduced to a single ply of material, and each stack of pieces then being reduced to a single piece.

The invention claimed is:

1. A method of automatically cutting out and unloading stacks of pieces from a lay-up made up of superposed layers of sheet material, the method comprising:

cutting out stacks of pieces from the lay-up on a cutting table on the basis of recorded information relating to the locations of the pieces on the surface of the lay-up;

unloading the stacks of pieces by means of at least one unloading tool that is controlled automatically;

splitting up the skeleton of the lay-up into a plurality of portions while the stacks of pieces are being cut out on the cutting table;

progressively bringing the lay-up onto an unloading table with the stacks of cut-out pieces and the skeleton of the lay-up not separated from one another; and successively unloading the stacks of cut-out pieces by using the information relating to the locations of the pieces to move the unloading tool adjacent to the stacks on the unloading table and to take off each stack from the remainder of the lay-up by moving the stacks substantially parallel to the plane of the lay-up, without interfering with the stacks of pieces that have not yet been unloaded, stacks of cut-out pieces and portions of the skeleton of the lay-up being unloaded in a manner such as to clear the way on the unloading table for the stacks of pieces that have not yet been unloaded.

2. A method according to claim 1, whereby the stacks of pieces slide over the unloading table.

3. A method according to claim 2, whereby, while the stacks of pieces are being moved over the unloading table, the stacks of pieces are supported by a cushion of air.

4. A method according to claim 1, whereby the stacks of pieces roll over the unloading table.

5. A method according to any one of claims 2, 3, or 4, whereby each stack of pieces is driven over the unloading table by bringing the unloading tool to bear against the surface of the stack and by moving said tool.

6. A method according to claim 1, whereby, after each stack of pieces has been taken off from the remainder of the lay-up, each stack of pieces is accompanied by the unloading tool to a collector device.

7. A method according to claim 1, whereby, after each stack of pieces has been taken off from the remainder of the lay-up, each stack of pieces is propelled by the unloading tool to a collector device.

8. A method according to claim 6 or 7, whereby the unloaded stacks of pieces are directed to at least one collector device to form predetermined sets of pieces.

9. A method according to any one of claim 6 or 7, whereby the unloaded stacks of pieces are directed to at least one collector bin.

10. A method according to claim 6 or 7, whereby the unloaded stacks of pieces are directed to a collector device to form therein at least one queue ordered in a predetermined manner.

11. A method according to claim 1, whereby at least some of the portions of the skeleton of the lay-up are removed automatically from the unloading table.

12. A method according to claim 11, whereby at least portions of the skeleton that are situated along the longitudinal edges of the lay-up are removed from the unloading table by automatic removal means that are distinct from the unloading tool.

13. A method according to claim 1, whereby each set of a plurality of adjacent stacks of pieces in the lay-up where the pieces have shapes such that they are mutually interlocking is unloaded as a single stack of pieces.

14. A method according to claim 1, whereby each stack of pieces of size smaller than a minimum predetermined value is included in a non-fragmented portion of the lay-up skeleton, the resulting set of pieces and skeleton being unloaded as a single stack.

15. A method according to claim 1, in which the lay-up is covered with a plastic film prior to cutting out the stacks of pieces, such that, prior to removing the stacks of pieces from the unloading table, the portion of plastics film cut out with each stack of pieces and situated on each stack is taken off automatically.

16. A method according to claim 15, whereby each portion of plastic film situated on each stack of cut-out pieces is taken off by means of the unloading tool and then removed.

17. A method according to claim 15 or 16, whereby the portion of plastic film is taken off by suction.

18. A method according to claim 1, whereby the unloaded stacks of pieces are wrapped individually.

19. A method according to claim 1, whereby the unloaded stacks of pieces are marked.

20. A method according to claim 19, whereby the marking is performed by marking means carried by the unloading tool, before the stacks of pieces are removed from the unloading table.

21. A method according to claim 18 or 19, whereby the marking is performed after the stacks of pieces have been wrapped.

22. A method according to claim 1, whereby unloading and removal information is stored that is associated with the stacks of pieces and with at least some of the portions of the skeleton, each item of said information comprising:

an unloading or removal rank;

an item of pick-up information relating to the location to which the unloading tool should be brought on the stack of pieces or on the portion of skeleton;

take-off information comprising information relating to a slide direction to be followed by the stack of pieces or by the portion of skeleton; and an unloading or removal address.

* * * * *